US007497674B2

(12) United States Patent
Tateishi et al.

(10) Patent No.: US 7,497,674 B2
(45) Date of Patent: Mar. 3, 2009

(54) SCROLL COMPRESSOR HAVING SHOULDER AND ROTATION-PREVENTING PORTIONS POSITIONED AS DIFFERENT PHASES

(75) Inventors: Taichi Tateishi, Aichi-ken (JP); Hajime Sato, Aichi-ken (JP); Susumu Matsuda, Aichi-ken (JP); Hisao Mizuno, Aichi-ken (JP); Yogo Takasu, Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/672,508

(22) Filed: Feb. 7, 2007

(65) Prior Publication Data

US 2007/0217934 A1 Sep. 20, 2007

(30) Foreign Application Priority Data

Mar. 20, 2006 (JP) ..... 2006-076621

(51) Int. Cl.
*F03C 2/00* (2006.01)
*F04C 2/00* (2006.01)
*F04C 18/00* (2006.01)

(52) U.S. Cl. ..... 418/55.3; 418/55.1; 418/55.2; 464/102

(58) Field of Classification Search ..... 418/551.1–55.6, 418/57; 464/102
See application file for complete search history.

(56) References Cited

U.S. PATENT DOCUMENTS 4,477,238 A * 10/1984 Terauchi ..... 418/55.2
6,585,501 B2 * 7/2003 Takeuchi et al. ..... 418/55.2
6,746,224 B2 * 6/2004 Itoh et al. ..... 418/55.2

FOREIGN PATENT DOCUMENTS

| | | | | |
|---|---|---|---|---|
| CN | 1673543 | | 9/2005 | |
| JP | 63050691 A | * | 3/1988 | ..... 418/55.2 |
| JP | 04311693 A | * | 11/1992 | ..... 418/55.2 |
| JP | 05071477 A | * | 3/1993 | ..... 418/55.2 |
| JP | 11-13657 A | | 1/1999 | |
| JP | 2000-274381 | | 10/2000 | |
| JP | 2001-165067 | | 6/2001 | |
| JP | 2002-5053 A | | 1/2002 | |

* cited by examiner

*Primary Examiner*—Theresa Trieu
(74) *Attorney, Agent, or Firm*—Lowe, Hauptman, Ham & Berner, LLP

(57) ABSTRACT

A scroll compressor prevents the rotation of an orbiting scroll and reduces manufacturing cost. This scroll compressor has a housing, a fixed scroll having a first end plate and a first spiral wall body, an orbiting scroll having a second end plate and a second spiral wall body, rotation-preventing portions provided for at least one of the housing and the orbiting scroll, which allow the orbiting scroll to revolve while preventing the rotation thereof, a wall body shoulder portion formed along an upper edge of the second spiral wall body, and a step portion formed on the first end plate. In this scroll compressor, the shoulder portion and the step portion contact with and slide along each other, and a phase at which the shoulder portion is disposed to the center of the orbiting scroll is different from phases at which the rotation-preventing portions are disposed.

2 Claims, 19 Drawing Sheets

SCROLL COMPRESSOR HAVING SHOULDER AND ROTATION-PREVENTING PORTIONS POSITIONED AS DIFFERENT PHASES

BACKGROUND OF THE INVENTION

1. Field of the Invention

The present invention relates to a scroll compressor.

This application is based on Japanese Patent Application No. 2006-076621, the content of which is incorporated herein by reference.

2. Description of Related Art

In a scroll compressor, a spiral wall body of a fixed scroll and a spiral wall body of an orbiting scroll are disposed together, and revolving motion of the orbiting scroll with respect to the fixed scroll gradually decreases the volumes of compression spaces formed between the wall bodies, so that a fluid present in the compression spaces is compressed.

Various types of rotation-preventing mechanisms which allow the orbiting scroll to revolve while the rotation thereof is prevented have been known (for example, see Japanese Unexamined Patent Application Publication No. 11-13657).

Furthermore, in the scroll compressor as described above, since the compression capacity can be improved by increasing the compression ratio without increasing the size of the compressor, a compressor in which scroll members have shoulder shapes has been practically used (for example, see Japanese Unexamined Patent Application Publication No. 2002-5053).

In the scroll compressor, as a mechanism for preventing the rotation of the orbiting scroll, a pin-ring type rotation-preventing mechanism has been well known. For the pin-ring type rotation-preventing mechanism, a step of driving a pin and a ring in a casing of the scroll compressor must be performed, and since this step requires high machining accuracy, the manufacturing cost is disadvantageously increased. On the other hand, when the machining accuracy required in this step is degraded in order to avoid an increase in manufacturing cost, the rotation-preventing performance for the orbiting scroll is disadvantageously degraded.

In the pin-ring type rotation-preventing mechanism, as the number of pin-ring pairs is increased, a load per pin is decreased. However, when the number of pin-ring pairs is increased, there has been a problem in that the manufacturing cost of the scroll compressor is increased. On the other hand, when the number of pin-ring pairs is decreased in order to avoid the increase in manufacturing cost of the scroll compressor, the load per pin is disadvantageously increased.

BRIEF SUMMARY OF THE INVENTION

The present invention has been conceived in order to solve the above problems, and an object of the present invention is to provide a scroll compressor which can prevent the rotation of an orbiting scroll and which can also reduce the manufacturing cost.

To achieve the above object, the present invention provides the following solutions.

The present invention provides a scroll compressor including: a housing; a fixed scroll having a first end plate and a first spiral wall body vertically provided on one surface thereof; an orbiting scroll which has a second end plate and a second spiral wall body vertically provided on one surface thereof, and by engagement between the first body and the second wall body, which is allowed to revolve and is prevented from rotation; rotation-preventing portions which are provided for at least one of the housing and the orbiting scroll, and which allow the orbiting scroll to revolve and prevent the rotation thereof; at least one wall-body shoulder portion provided along an upper edge of the second spiral wall body, the height of the wall-body shoulder portion being small at a central side in the spiral direction and being great at an exterior end side thereof; and at least one end-plate step portion provided on said one surface of the first end plate at a position facing the wall-body shoulder portion, the height of the end-plate step portion being great at a central side in the spiral direction and being small at an exterior end side thereof. In the scroll compressor described above, a phase at which the wall-body shoulder portion is disposed with respect to the center of the orbiting scroll is different from phases at which the rotation-preventing portions are disposed.

According to the present invention, besides the rotation-preventing portions, since the wall-body shoulder portion formed along the upper edge of the second wall body and the end-plate step portion formed on the first end plate are brought into contact with and slide along each other, the wall-body shoulder portion and the end-plate step portion prevent the rotation of the orbiting scroll.

When the orbiting scroll is driven to revolve, it simultaneously receives a force for rotation. The direction of this rotation is toward a central side along the spiral direction of the first wall body (direction when the orbiting scroll revolves). The wall-body shoulder portion is formed so that the height is small at the central side in the spiral direction and is great at the exterior end side, and the end-plate step portion is formed so that the height is great at the central side of the spiral direction and is small at the exterior end side. In the case described above, when the orbiting scroll is about to rotate in the above rotation direction, the wall-body shoulder portion and the end-plate step portion are brought into contact with each other, so that the rotation of the scroll compressor can be prevented.

Since the phase at which the wall-body shoulder portion is disposed with respect to the center of the orbiting scroll is different from the phases at which the rotation-preventing portions are disposed, the number of places at which the rotation-preventing portions are disposed can be decreased, and as a result, the manufacturing cost can be reduced.

As described above, since it is possible to prevent the rotation of the orbiting scroll, the wall-body shoulder portion and the end-plate step portion can share the role of the rotation-preventing portions. In particular, when the phase at which the wall-body shoulder portion is disposed with respect to the center of the orbiting scroll is made different from the phases at which the rotation-preventing portions are disposed, the role of a rotation-preventing portion which is essentially disposed at a place at which the wall-body shoulder portion is disposed can be performed by the wall-body shoulder portion and the end-plate step portion, and hence the above rotation-preventing portion can be eliminated. Accordingly, the number of places at which the rotation-preventing portions are disposed can be decreased, and as a result, the manufacturing cost can be reduced.

In the present invention, among intervals between the phases at which the rotation-preventing portions are disposed with respect to the center of the orbiting scroll, at least one interval between phases is larger than intervals between the other phases, and the wall-body shoulder portion or the end-plate step portion is preferably disposed between rotation-preventing portions forming said at least one interval.

When the structure as described above is formed, since the wall-body shoulder portion or the end-plate step portion is disposed between the rotation-preventing portions forming said at least one interval, the rotation-preventing performance for the orbiting scroll can be improved.

The rotation of the orbiting scroll can be prevented by the wall-body shoulder portion and the rotation-preventing portions only when the orbiting scroll is located at a predetermined eccentric phase with respect to the phase of the wall-body shoulder portion or the phases of the rotation-preventing portions. Hence, compared to the case in which the wall-body shoulder portion or the end-plate step portion is not provided between the rotation-preventing portions forming said at least one interval, the rotation of the orbiting scroll can be more uniformly prevented, and as a result, the rotation-preventing performance can be further improved.

In the present invention, the rotation-preventing portions and the wall-body shoulder portion or the end-plate step portion are preferably disposed at approximately equivalent intervals with respect to the center of the orbiting scroll.

By the structure as described above, since the wall-body shoulder portion and the rotation-preventing portions are disposed at approximately equivalent intervals, the rotation-preventing performance for the orbiting scroll can be further improved.

The rotation of the orbiting scroll can be prevented by the wall-body shoulder portion and the rotation-preventing portions only when the orbiting scroll is located at a predetermined eccentric phase with respect to the phase of the wall-body shoulder portion or the phases of the rotation-preventing portions. Hence, when the wall-body shoulder portion and the rotation-preventing portions are uniformly disposed at approximately equivalent intervals, the rotation of the orbiting scroll can be uniformly prevented, and as a result, the rotation-preventing performance can be further improved.

In the present invention as described above, a contact portion of the wall-body shoulder portion in contact with the end-plate step portion and a contact portion of the end-plate step portion in contact with the wall-body shoulder portion are preferably provided with surface treatment layers for improving abrasion resistance.

By the structure as described above, since the wall-body shoulder portion and the end-plate step portion are provided with the surface treatment layers, degradation in rotation-preventing performance for the orbiting scroll can be prevented.

Since the contact portion of the wall-body shoulder portion in contact with the end-plate step portion and the contact portion of the end-plate step portion in contact with the wall-body shoulder portion are provided with the surface treatment layers which improve the abrasion resistance, the contact portion of the wall-body shoulder portion and that of the end-plate step portion can be prevented from being abraded. Since the abrasion is prevented, the contact state between the wall-body shoulder portion and the end-plate step portion can always be maintained constant, and hence the degradation in rotation-preventing performance caused by the wall-body shoulder portion and the end-plate step portion can be prevented.

In the present invention, the contact portion of the wall-body shoulder portion in contact with the end-plate step portion is preferably provided with a wall-body contact portion formed of an abrasion resistant member, and the contact portion of the end-plate step portion in contact with the wall-body shoulder portion is preferably provided with an end-plate contact portion formed of an abrasion resistant member.

By the structure as described above, since the wall-body contact portion is provided on the wall-body shoulder portion, and the end-plate contact portion is provided on the end-plate step portion, the degradation in rotation-preventing performance for the orbiting scroll can be prevented.

Since the contact portion of the wall-body shoulder portion in contact with the end-plate step portion is provided with the wall-body contact portion formed of an abrasion resistant member, the contact portion of the wall-body shoulder portion is prevented from being abraded. In addition, the contact portion of the end-plate step portion in contact with the wall-body shoulder portion is provided with the end-plate contact portion formed of an abrasion resistant member, the contact portion of the end-plate step portion is prevented from being abraded. Since the abrasion is prevented, the contact state between the wall-body shoulder portion and the end-plate step portion can always be maintained constant, and hence, the degradation in rotation-preventing performance caused by the wall-body shoulder portion and the end-plate step portion can be prevented.

In the present invention, said at least one wall-body shoulder portion and said at least one end-plate step portions are preferably provided at a plurality of positions.

By the structure as described above, since the wall-body shoulder portions and the end-plate step portions are provided at a plurality of positions, the manufacturing cost of the scroll compressor can be reduced.

When the wall-body shoulder portions and the end-plate step portions are provided at a plurality of positions, the rotation-preventing function of the orbiting scroll can be shared by the wall-body shoulder portions and the end-plate step portions, and the number of rotation-preventing portions made of pins and rings can be decreased. Since the number of the rotation-preventing portions can be decreased, the manufacturing cost of the scroll compressor can be reduced.

In the present invention, the fixed scroll is preferably disposed so that said one surface of the first end plate faces upward, and the orbiting scroll is preferably disposed so that said one surface of the second end plate faces downward.

By the structure as described above, since the fixed scroll is disposed so that one surface of the first end plate faces upward, the degradation in rotation-preventing performance for the orbiting scroll can be prevented.

Since the fixed scroll is disposed so that one surface of the first end plate faces upward, in the vicinity of the surface of the end-plate step portion at the exterior end side, a lubricant remains due to gravity, the flow of a fluid, and the like. The wall-body shoulder portion scrapes away the lubricant by the revolving motion of the orbiting scroll, and the contact surface between the wall-body shoulder portion and the end-plate step portion is force-fed with the lubricant. Since the contact surface between the wall-body shoulder portion and the end-plate step portion is force-fed as described above, abrasion and seizure can be prevented, and the degradation in rotation-preventing performance for the orbiting scroll can be prevented.

In the present invention, the fixed scroll and the orbiting scroll are disposed so that the first end plate and the second end plate preferably intersect a horizontal surface, and the wall-body shoulder portion and the end-plate step portion are preferably disposed in the vicinities of lower ends of the second end plate and the first end plate, respectively.

By the structure as described above, since the first end plate and the second end plate are disposed to intersect the horizontal surface, and the wall-body shoulder portion and the end-plate step portion are located in the vicinities of the lower ends of the second end plate and the first end plate, respectively, the degradation in rotation-preventing performance for the orbiting scroll can be prevented.

Since the wall-body shoulder portion and the end-plate step portion are located in the vicinities of the lower ends of the second end plate and the first end plate, respectively, a lubricant remains in the vicinity of the end-plate step portion due to gravity, the flow of a fluid, and the like. The wall-body shoulder portion scrapes away the lubricant by the revolving motion of the orbiting scroll, and the contact surface between the wall-body shoulder portion and the end-plate step portion is force-fed with the lubricant. Since the contact surface between the wall-body shoulder portion and the end-plate step portion is force-fed as described above, abrasion and seizure can be prevented, and the degradation in rotation-preventing performance for the orbiting scroll can be prevented.

In the present invention, it is preferable that the rotation-preventing portions each have a housing-side support portion, which is disposed at the housing and has a cylindrical surface, a scroll-side support portion, which is disposed in the orbiting scroll and has a cylindrical surface, and a restricting portion which restricts a distance between a central axis of the housing-side support portion and that of the scroll-side support portion to have a predetermined length, that the housing-side support portion be rotatably supported with respect to the housing or the restricting portion, and that the scroll-side support portion be rotatably supported with respect to the orbiting scroll or the restricting portion.

By the structure as described above, since the rotation-preventing portions each have the housing-side support portion, the scroll-side support portion, and the restricting portion, the housing-side support portion is rotatably supported with respect to the housing or the restricting portion, and the scroll-side support portion is rotatably supported with respect to the orbiting scroll or the restricting portion, the rotation of the orbiting scroll can be prevented.

In addition, the above predetermined length is preferably set to be equal to the revolution radius.

According to the present invention, besides the plurality of rotation-preventing portions, since the wall-body shoulder portion formed on the second wall body and the end-plate step portion formed on the first end plate are brought into contact with and slide along each other, the wall-body shoulder portion and the end-plate step portion can prevent the rotation of the orbiting scroll, and in addition, the manufacturing cost can be effectively reduced.

DETAILED DESCRIPTION OF THE INVENTION

First Embodiment

Hereinafter, a first embodiment of the present invention will be described with reference to FIGS. 1 to 18.

Figure 1:
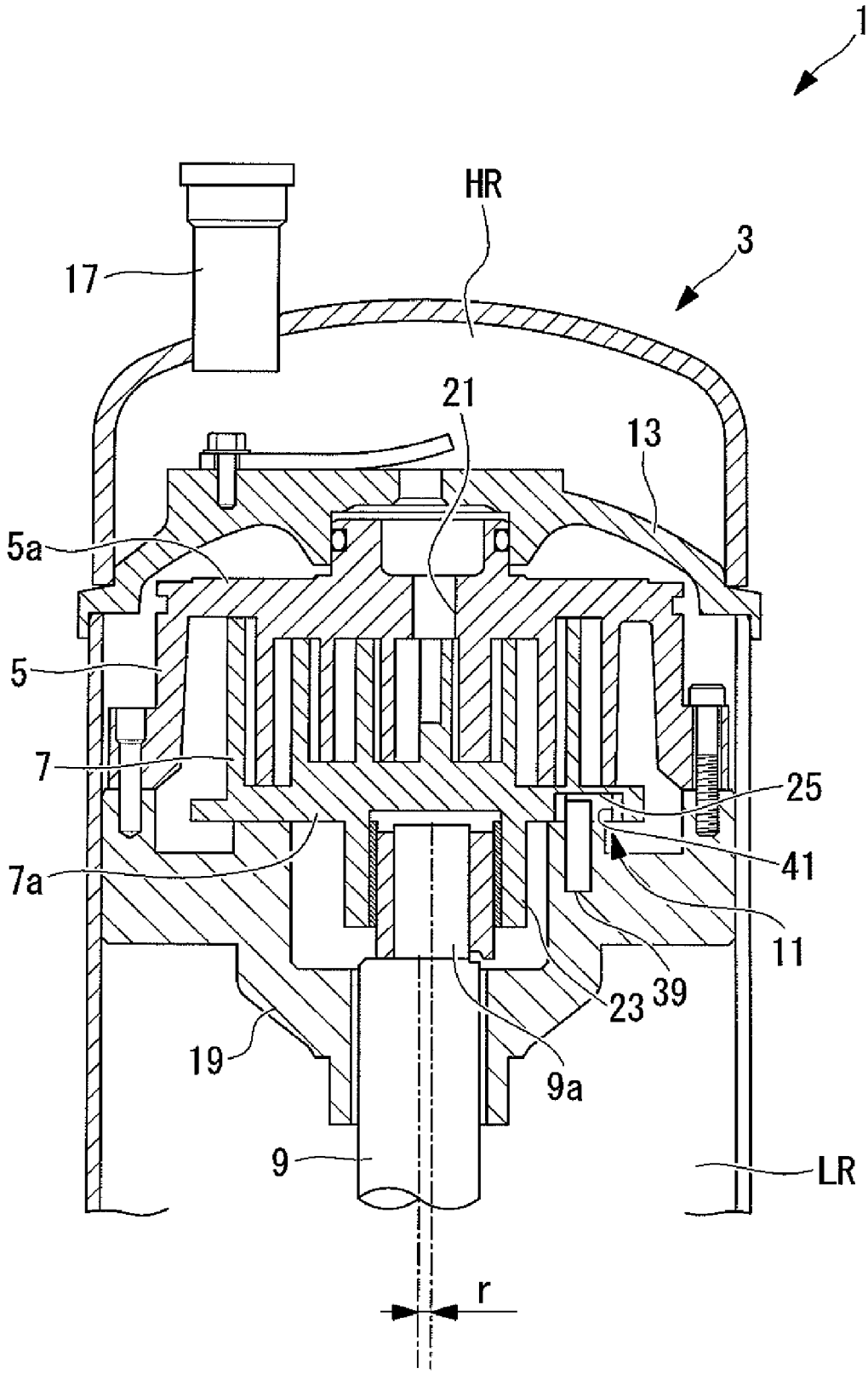
FIG. 1 is a cross-sectional view illustrating the structure of a scroll compressor according to a first embodiment of the present invention.

FIG. 1 is a cross-sectional view of the structure of a scroll compressor according to this embodiment.

A scroll compressor 1 has a housing 3, a fixed scroll 5, an orbiting scroll 7, a rotating shaft 9, and rotation-preventing portions 11, as shown in FIG. 1.

As shown in FIG. 1, the housing 3 is an air-tight container in which the fixed scroll 5, the orbiting scroll 7, and the like are disposed. For the housing 3, a discharge cover 13, an inlet pipe (not shown), an outlet pipe 17, and a frame 19 are provided. The discharge cover 13 divides the inside of the housing 3 into a high-pressure chamber HR and a low-pressure chamber LR. The inlet pipe supplies a fluid into the low-pressure chamber LR from the outside. The outlet pipe 17 discharges a fluid outside from the high-pressure chamber HR. The frame 19 supports the fixed scroll 5 and the orbiting scroll 7.

As shown in FIG. 1, the rotating shaft 9 transmits a rotation drive force of a motor (not shown), which is provided at a lower portion in the housing 3, to the orbiting scroll 7. The rotating shaft 9 is supported inside the housing 3 in an approximately vertical direction and is also rotatably supported. An eccentric pin 9*a*, which drives the revolution of the orbiting scroll 7, is provided on an upper end portion of the rotating shaft 9. The eccentric pin 9*a* is a cylindrical member which protrudes upward from the end surface of the rotating shaft 9 and which is located at a position eccentric from the rotation center thereof by a revolution radius r of the orbiting scroll 7.

As shown in FIG. 1, the fixed scroll 5 and the orbiting scroll 7 compress a fluid supplied into the low-pressure chamber LR of the housing 3 and then supply the fluid into the high-pressure chamber HR. As shown in FIG. 1, the fixed scroll 5 is disposed at an upper side, the orbiting scroll 7 is disposed at a lower side, and the two scrolls 5 and 7 are disposed so as to be engaged with each other.

Since it is fixed to and supported by the frame 19, the fixed scroll 5 is fixed to the housing 3. At a backside center (upper-side center in FIG. 1) of an end plate 5*a* of the fixed scroll 5, a discharge port 21 for a compressed fluid is provided. In addition, the orbiting scroll 7 is supported so as to be able to revolve with respect to the fixed scroll 5. At a backside center (lower-side center in FIG. 1) of an end plate 7*a* of the orbiting scroll 7, a boss 23 into which the eccentric pin 9*a* of the rotating shaft 9 is inserted is provided. In addition, at the backside of the end plate 7*a*, recess portions 25 into which rings 41 of rotation-preventing portions 11 are disposed are provided circumferentially at a predetermined radius from the center of the orbiting scroll 7. The recess portions 25 each have an approximately circular shape when viewed from the rotating shaft 9 side.

Figure 2:
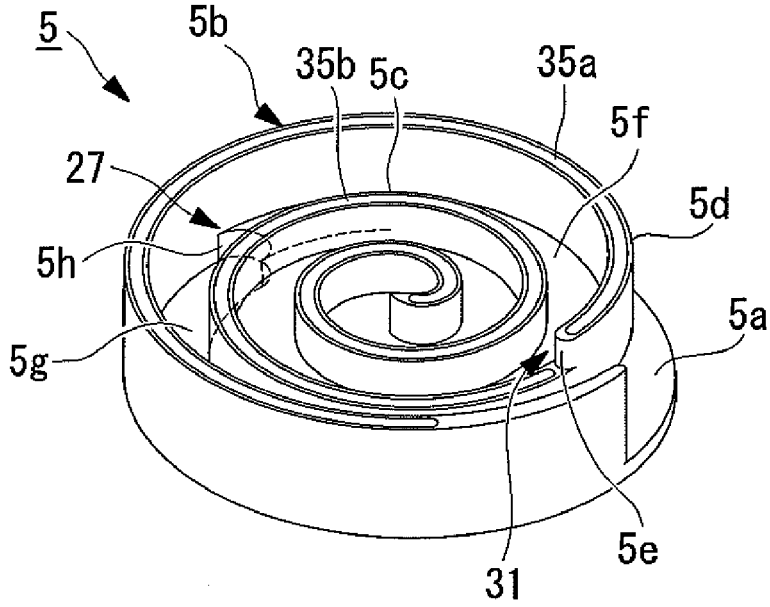
FIG. 2 is a perspective view illustrating the structure of a fixed scroll shown in FIG. 1.
Figure 3:
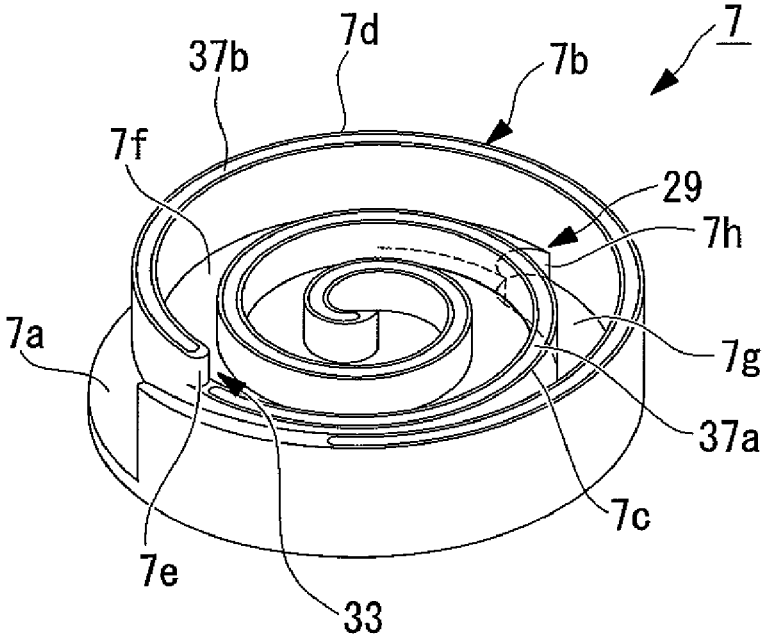
FIG. 3 is a perspective view illustrating the structure of an orbiting scroll shown in FIG. 1.

FIG. 2 is a perspective view illustrating the structure of the fixed scroll 5 shown in FIG. 1. FIG. 3 is a perspective view illustrating the orbiting scroll 7 shown in FIG. 1.

As shown in FIG. 2, the fixed scroll 5 is formed of the end plate (first end plate) 5*a* and a spiral wall body 5*b* vertically provided on one surface thereof. In addition, as shown in FIG. 3, as the fixed scroll 5, the orbiting scroll 7 is formed of the end plate 7*a* and a spiral wall body 7*b* vertically provided on one surface thereof, and in particular, the wall body 7*b* has a shape substantially equal to that of the wall body 5*b* of the fixed scroll 5. The orbiting scroll 7 is eccentric with respect to the fixed scroll 5 by the revolution radius r and is disposed apart from the fixed scroll 5 by 180° in terms of the phase shift. In this state, the orbiting scroll 7 and the fixed scroll 5 are assembled so that the wall bodies 5*b* and 7*b* are engaged with each other.

The end plate 5*a* of the fixed scroll 5 is formed to have a step portion (end-plate step portion) 27 on the surface on which the wall body 5*b* is vertically provided so that along the spiral direction of the wall body 5*b*, the height of the step portion is great at a central side and is small at an exterior end side. In addition, as the end plate 5*a* of the fixed scroll 5, the end plate 7*a* of the orbiting scroll 7 is formed to have a step portion 29 on the surface on which the wall body 7*b* is vertically provided so that along the spiral direction of the wall body 7*b*, the height of the step portion is great at a central side and is small at an exterior end side.

Since the step portion 27 is formed, the bottom surface of the end plate 5*a* is divided into two parts, that is, a bottom surface 5*f* having a shallow depth provided at the central side, and a bottom surface 5*g* having a great depth provided at the exterior end side. Between the adjacent bottom surfaces 5*f* and 5*g*, a connection wall surface 5*h* is vertically formed which forms the step portion 27 and which connects the bottom surfaces 5*f* and 5*g*. In addition, as the above end plate 5*a*, since the step portion 29 is formed, the bottom surface of the end plate 7*a* is also divided into two parts, that is, a bottom surface 7*f* having a shallow depth provided at the central side, and a bottom surface 7*g* having a great depth provided at the exterior end side. Between the adjacent bottom surfaces 7*f* and 7*g*, a connection wall surface 7*h* is vertically formed which forms the step portion 29 and which connects the bottom surfaces 7*f* and 7*g*.

The wall body 5*b* of the fixed scroll 5 is formed so that its spiral upper edge is divided into two portions at a place corresponding to the step portion 29 of the orbiting scroll 7, and between the two portions, a shoulder portion 31 is formed, the height of which is small at the spiral central side and is great at the exterior end side. In addition, as the wall body 5*b*, the wall body 7*b* of the orbiting scroll 7 is formed so that its spiral upper edge is divided into two portions at a place corresponding to the step portion 27 of the fixed scroll 5, and between the two portions, a shoulder portion (wall body shoulder portion) 33 is formed, the height of which is small at the spiral central side and is greater at the exterior end side.

In particular, the upper edge of the wall body 5*b* is divided into two portions, that is, a low upper edge 5*c* provided at the central side and a high upper edge 5*d* provided at the exterior end side, and between the adjacent two upper edges 5*c* and 5*d*, a connection edge 5*e* is formed in a vertical direction with respect to the orbiting surface to connect the two upper edges 5*c* and 5*d*. In addition, as the wall body 5*b*, the upper edge 7*b* is divided into two portions, that is, a low upper edge 7*c* provided at the central side and a high upper edge 7*d* provided at the exterior end side, and between the adjacent two upper edges 7*c* and 7*d*, a connection edge 7*e* is formed in a vertical direction with respect to the orbiting surface to connect the two upper edges 7*c* and 7*d*.

When viewed from the orbiting scroll 7 side, the connection edge 5*e* is smoothly and continuously formed between the inside and the outside surfaces of the wall body 5*b* so as to have a semicircular shape having a diameter equal to the thickness of the wall body 5*b*. In addition, as the connection edge 5*e*, the connection edge 7*e* is smoothly and continuously formed between the inside and the outside surfaces of the wall body 7*b* to have a semicircular shape having a diameter equal to the thickness of the wall body 7*b*.

When the end plate 5*a* is viewed along the orbiting axial direction, the connection wall surface 5*h* has a circular arc which coincides with the envelope curve drawn by the connection edge 7*e* when the orbiting scroll 7 orbits. In addition, as the connection wall surface 5*h*, the connection wall surface 7*h* has a circular arc which coincides with the envelope curve drawn by the connection edge 5*e*.

Tip seals 35*a* and 35*b*, which are disconnected from each other in the vicinity of the connection edge 5*e*, are provided on the upper edges 5*d* and 5*c*, respectively, of the wall body 5*b* of the fixed scroll 5. In addition, tip seals 37*a* and 37*b*, which are disconnected to each other in the vicinity of the connection edge 7*e*, are provided on the upper edges 7*c* and 7*d*, respectively, of the wall body 7*b* of the orbiting scroll 7.

These tip seals are used to seal tip-seal spaces formed between the upper edges (tooth tops) and the bottom surfaces (tooth bottoms) of the orbiting scroll 7 and the fixed scroll 5 to suppress the leak of a compressed gas fluid to be as small as possible.

That is, when the fixed scroll 5 and the orbiting scroll 7 are assembled together, the tip seal 37*a* provided on the low upper edge 7*c* is brought into contact with the shallow depth bottom surface 5*f*, and the tip seal 37*b* provided on the high upper edge 7*d* is brought into contact with the great depth bottom surface 5*g*. Simultaneously, the tip seal 35*b* provided on the low upper edge 5*c* is brought into contact with the shallow depth bottom surface 7*f*, and the tip seal 35*a* provided on the high upper edge 5*d* is brought into contact with the great depth bottom surface 7*g*.

As a result, between the two scrolls 5 and 7, there is formed a plurality of compression spaces C defined by the end plates 5*a* and 7*a* and wall bodies 7*b* and 5*b* facing thereto, respectively.

In FIG. 2, in order to show the shoulder shape of the fixed scroll 5, the fixed scroll 5 is shown upside down.

Figure 4:
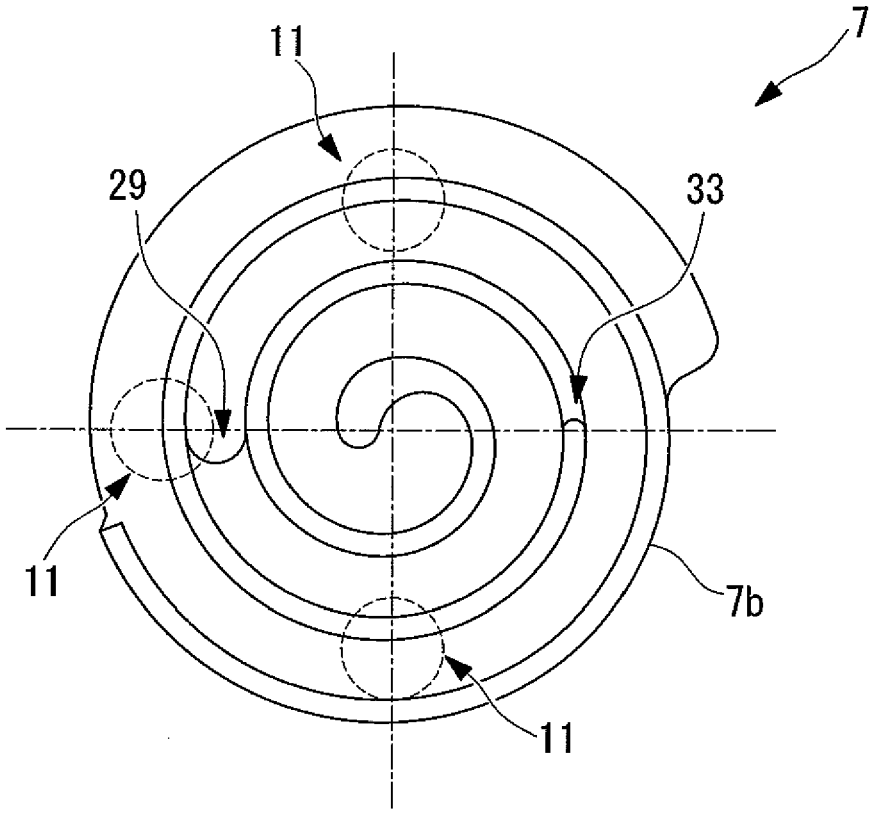
FIG. 4 is a view illustrating the positions at which rotation-preventing portions shown in FIG. 1 are disposed.
Figure 5:
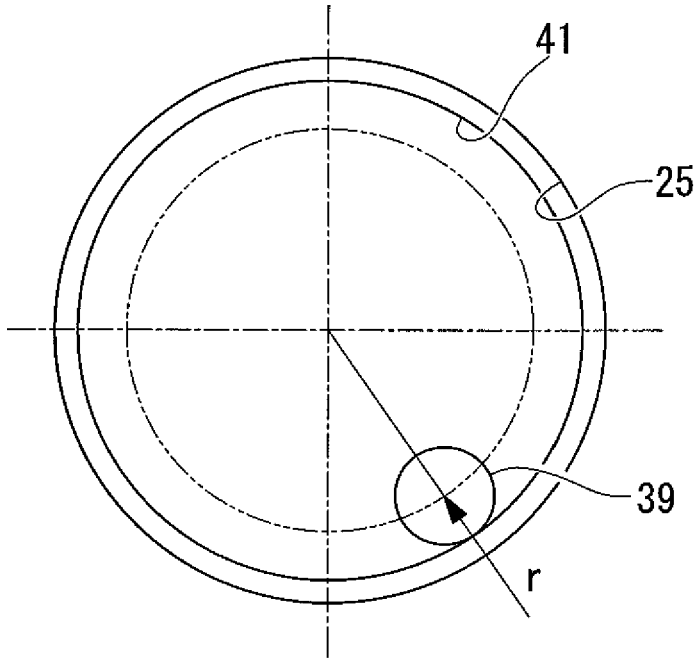
FIG. 5 is a partially enlarged view illustrating the structure of the rotation-preventing portion shown in FIG. 1.

FIG. 4 is a view illustrating the places at which the rotation-preventing portions shown in FIG. 1 are provided, the view being obtained when the orbiting scroll is viewed from the fixed scroll side. FIG. 5 is a partially enlarged view illustrating the structure of the rotation-preventing portion shown in FIG. 1 when it is viewed from the rotating shaft side.

As shown in FIG. 1, the rotation-preventing portion 11 allows the orbiting scroll 7 to revolve and also prevents the rotation thereof. In this embodiment, the rotation-preventing portions 11 are provided at three places as shown in FIG. 4. The three rotation-preventing portions 11 are provided at phase intervals of approximately 90° with respect to the center of the orbiting scroll 7 together with the shoulder portion 33 thereof.

The rotation-preventing portion 11 has, as shown in FIG. 1, a pin (housing-side support portion) 39 disposed at the frame 19 and a ring (restricting portion) 41 disposed in the recess portion 25 (scroll-side support portion) 25 of the orbiting scroll 7. The pin 39 is a cylindrical member driven into the frame 19 and is disposed to extend from the frame 19 to the orbiting scroll 7. The ring 41 is a cylindrical member disposed inside the recess portion 25 provided in the orbiting scroll 7. The radius of the inner periphery of the ring 41 is formed so that, when the outer periphery of the pin 39 is in contact with the above inner periphery, the center of the pin 39 is apart from the center of the ring 41 by the revolution radius r of the orbiting scroll 7.

Since the rotation-preventing portion 11 of this embodiment is the pin-ring-type rotation-preventing portion 11 using the pin 39 and the ring 41, as described above, compared to the case in which the Oldham link is used as the rotation-preventing portion, the manufacturing cost of the scroll compressor 1 can be reduced.

Next, the operation of the scroll compressor 1 having the above structure will be described.

First, the compression of a fluid by the scroll compressor 1 will be described.

As shown in FIG. 1, the rotating shaft 9 of the scroll compressor 1 transmits a rotation drive force generated by the motor to the orbiting scroll 7. Since the eccentric pin 9*a* of the rotating shaft 9 and the boss 23 of the orbiting scroll 7 are relative rotatably connected by a bearing or the like, the orbiting motion is driven. Since the rotation of the orbiting scroll 7 is prevented by the rotation-preventing portions 11 besides the shoulder portion 33 and the step portion 27, the orbiting scroll 7 revolves while the rotation thereof is prevented.

FIGS. 6 to 9 are views illustrating the movement of compression spaces of the scroll compressor shown in FIG. 1. These views show the scroll compressor when the fixed scroll side is viewed from the rotating shaft side.

Figure 6:
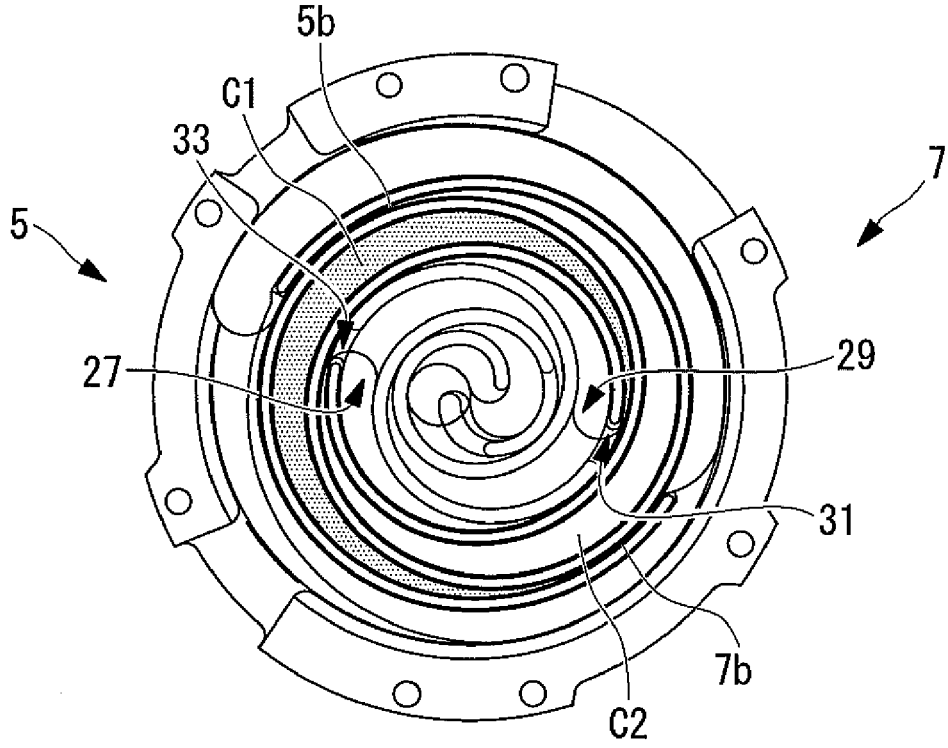
FIG. 6 is a view illustrating the motion of compression spaces in the scroll compressor shown in FIG. 1.

When the orbiting scroll 7 revolves, the wall body 5*b* of the fixed scroll 5 and the wall body 7*b* of the orbiting scroll 7 are brought into contact with each other, as shown in FIG. 6, and hence two compression spaces C1 and C2 are formed. The compression spaces C1 and C2 are simultaneously formed at the exterior ends of the fixed scroll 5 and the orbiting scroll 7. In the compression spaces C1 and C2 thus formed, a fluid in the low-pressure chamber LR is trapped. At this stage, the compression spaces C1 and C2 are sandwiched between the great depth bottom surface 5*g* of the fixed scroll 5 and the great depth bottom surface 7*g* of the orbiting scroll 7.

Figure 7:
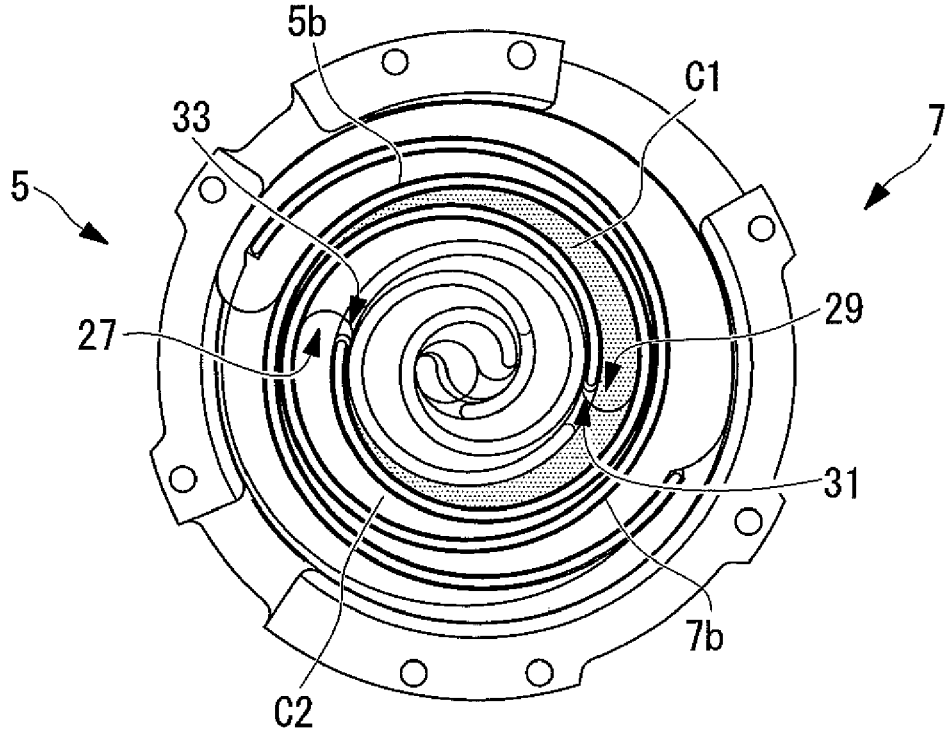
FIG. 7 is a view illustrating the motion of the compression spaces in the scroll compressor shown in FIG. 1.

When the orbiting scroll 7 is orbited from the state shown in FIG. 6 by approximately 180°, the two compression spaces C1 and C2 are moved to the central sides along the respective spiral wall bodies 5*b* and 7*b*, as shown in FIG. 7. The volumes of the two compression spaces C1 and C2 are decreased when they are moved to the central sides, and as a result, the fluid in the compression spaces C1 and C2 is compressed.

From the state shown in FIG. 6 to that shown in FIG. 7, the shoulder portion 31 of the fixed scroll 5 and the step portion 29 of the orbiting scroll 7 are moved while being in contact with each other. On the other hand, the step portion 27 of the fixed scroll 5 and the shoulder portion 33 of the orbiting scroll 7 are moved while being in contact with each other or being apart from each other with a predetermined gap therebetween. This predetermined gap is preferably set so that even when the fluid in the compression space leaks through this gap, the influence thereof can be ignored.

Figure 8:
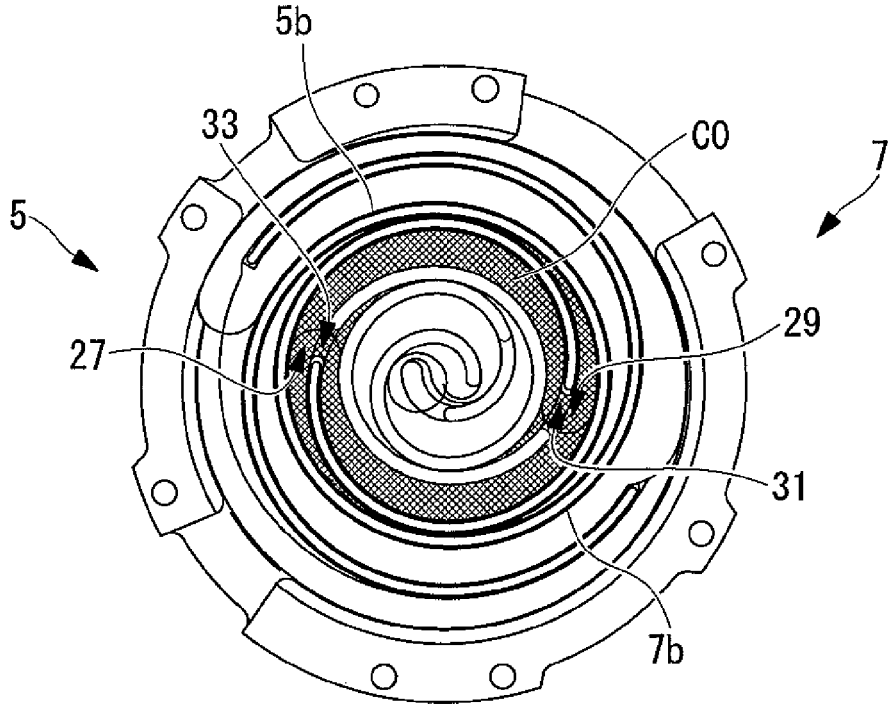
FIG. 8 is a view illustrating the motion of the compression spaces in the scroll compressor shown in FIG. 1.

When the orbiting scroll 7 is orbited from the state shown in FIG. 7 by approximately 90°, the two compression spaces C1 and C2 are made to communicate with each other to form one compression space C0, as shown in FIG. 8. That is, when the orbiting scroll 7 in the state shown in FIG. 7 is orbited, since the shoulder portion 31 and the step portion 29 are separated from each other, the gap therebetween is increased, and the gap between the step portion 27 and the shoulder portion 33 is also increased. The compression spaces C1 and C2 are made to communicate through the gap between the shoulder portion 31 and the step portion 29 and the gap between the step portion 27 and the shoulder portion 33.

Figure 9:
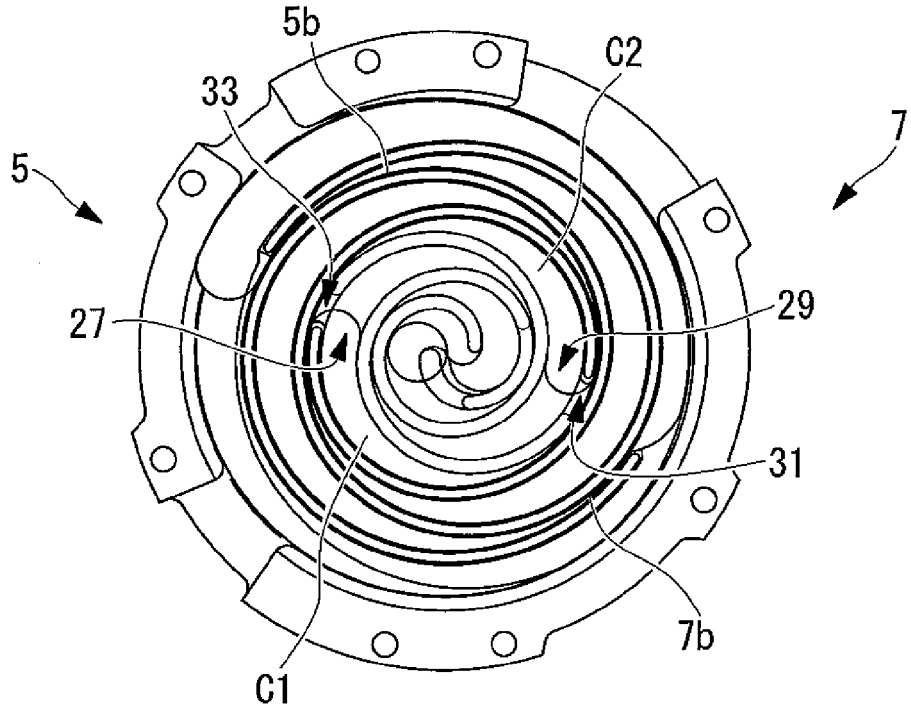
FIG. 9 is a view illustrating the motion of the compression spaces in the scroll compressor shown in FIG. 1.

Furthermore, when the orbiting scroll 7 is orbited from the state shown in FIG. 8 by approximately 90°, the compression space C0 is again divided into the compression spaces C1 and C2, as shown in FIG. 9. That is, since the shoulder portion 31 and the step portion 29 are again brought into contact with each other, and simultaneously, the step portion 27 and the shoulder portion 33 are brought into contact with each other or are close to each other with the above predetermined gap therebetween, the compression space C0 is again divided into the compression spaces C1 and C2. At this stage, the compression spaces C1 and C2 are sandwiched between the shallow depth bottom surface 5*f* of the fixed scroll 5 and the shallow depth bottom surface 7*f* of the orbiting scroll 7. Hence, the volumes of the compression spaces C1 and C2 are decreased also in the axial direction of the rotating shaft 9, so that the fluid inside is further compressed to have a higher pressure.

Subsequently, as the orbiting scroll 7 is orbited, the compression spaces C1 and C2 are moved to the central sides along the respective spiral wall bodies 5*b* and 7*b*. Finally, the discharge port 21 provided at the center of the fixed scroll 5 communicates with the compression spaces C1 and C2, and as a result, the compressed fluid is discharged into the high-pressure chamber HR.

Then, the operation of the rotation prevention of the orbiting scroll, which is a feature of the present invention, will be described.

Figure 10:
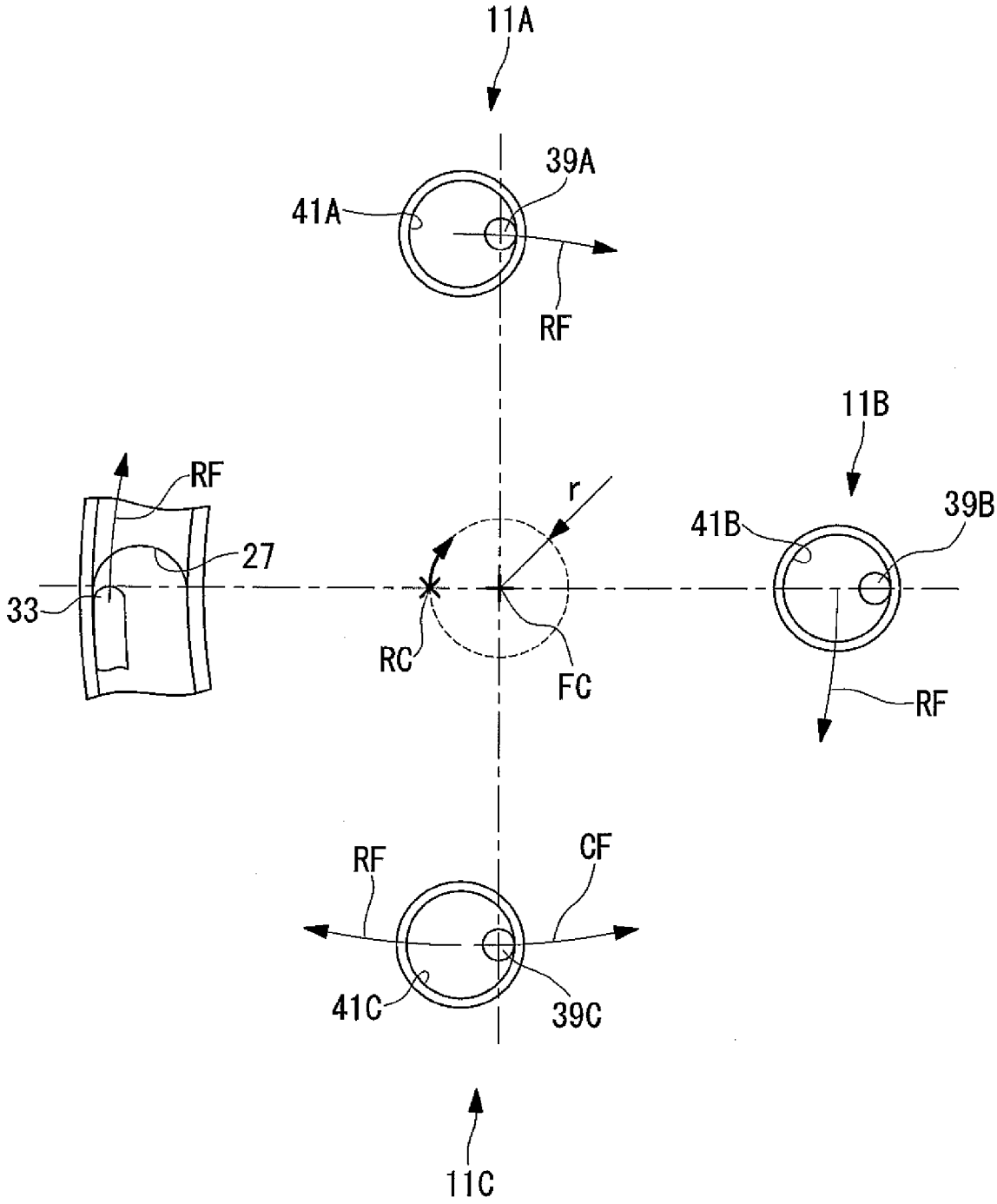
FIG. 10 is a schematic view illustrating the rotation prevention of an orbiting scroll by a step portion, a shoulder portion, and rotation-preventing portions.

In the orbiting scroll 7, the shoulder portion 33 and the step portion 27, in the state shown in FIG. 6, and the rotation-preventing portions 11 are disposed as shown in FIG. 10.

In order to discriminate the three rotation-preventing portions 11, they are named rotation-preventing portions 11A, 11B, and 11C in a clockwise direction from the shoulder portion 33 and the step portion 27. In accordance with this discrimination, the pins 39 and the rings 41 are named pins 39A, 39B, and 39C and 41A, 41B, and 41C, respectively, in the same manner as described above. Since the pins 39A, 39B, and 39C are provided in the frame 19, they are fixed at phase intervals of approximately 90° with respect to a center (intersection point of two chain lines shown in the figure) FC of the fixed scroll 5. In addition, a center RC of the orbiting scroll 7 is shown in the figure. The center RC revolves around the center FC of the fixed scroll 5 in a clockwise direction along the circumference having a revolution radius r. The rings 41A, 41B, and 41C and the shoulder portion 33 are provided in the orbiting scroll 7 and revolve therewith.

In FIG. 10, the center RC of the orbiting scroll 7 is located at a place closest to the step portion 27. In this state, when a force RF rotating the orbiting scroll 7 acts on the rings 41A, 41B, and 41C and the shoulder portion 33, a force CF preventing the rotation of the orbiting scroll 7 acts only on the rotation-preventing portion 11C including the ring 41C. That is, in the rotation-preventing portions 11A and 11B, when the rotation force RF acts on the rings 41A and 41B, since the rings 41A and 41B can revolve around the center RC, the force CF preventing the rotation of the orbiting scroll 7 does not act on the rotation-preventing portions 11A and 11B.

In addition, since the shoulder portion 33 has a gap with the step portion 27, when the rotation force RF acts on the shoulder portion 33, it is movable, and hence the force CF preventing the rotation of the orbiting scroll 7 does not act thereon. On the other hand, the center of the ring 41C is located on the line along which the rotation force RF acts on the pin 39C and also at a position opposite to the direction of the force RF. Hence, even when the rotation force RF acts on the ring 41C, it cannot revolve around the center RC. That is, the rotation-preventing force CF acts on the contact portion of the ring 41C with the pin 39C.

Figure 11:
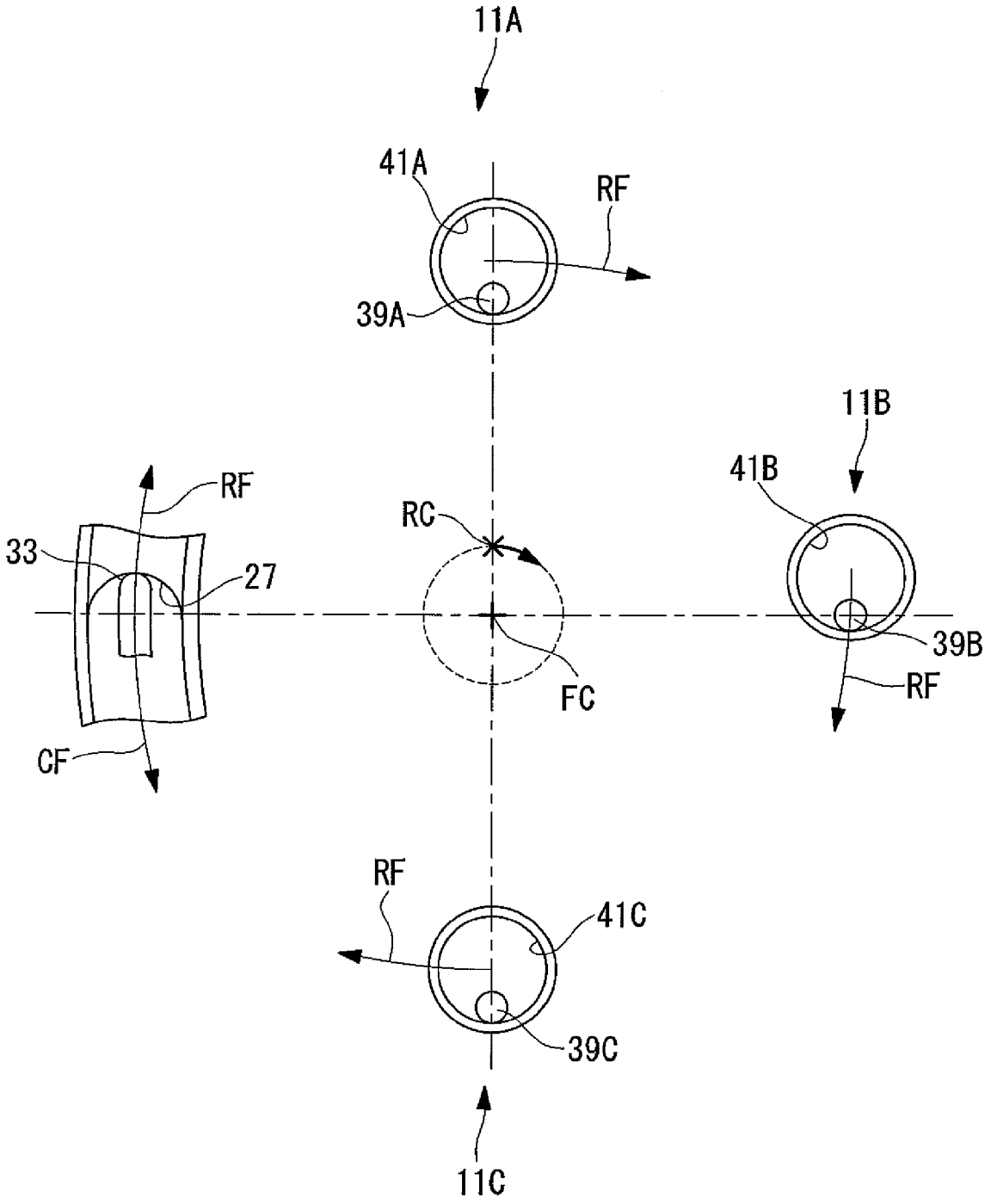
FIG. 11 is a schematic view illustrating the rotation prevention of the orbiting scroll by the step portion, the shoulder portion, and the rotation-preventing portions.

Next, the case in which the orbiting scroll 7 is orbited by approximately 90° so that the center RC is located closest to the rotation-preventing portion 11A will be described with reference to FIG. 11.

In this state, by the rotation force RF, the shoulder portion 33 and the step portion 27 are brought into contact with each other, and hence the rotation-preventing force CF acts on the contact portion of the shoulder portion 33 with the step portion 27. In the rotation-preventing portions 11A, 11B, and 11C, the rings 41A, 41B, and 41C can revolve by the rotation force RF around the center RC, and hence the rotation-preventing force CF is not generated.

Figure 12:
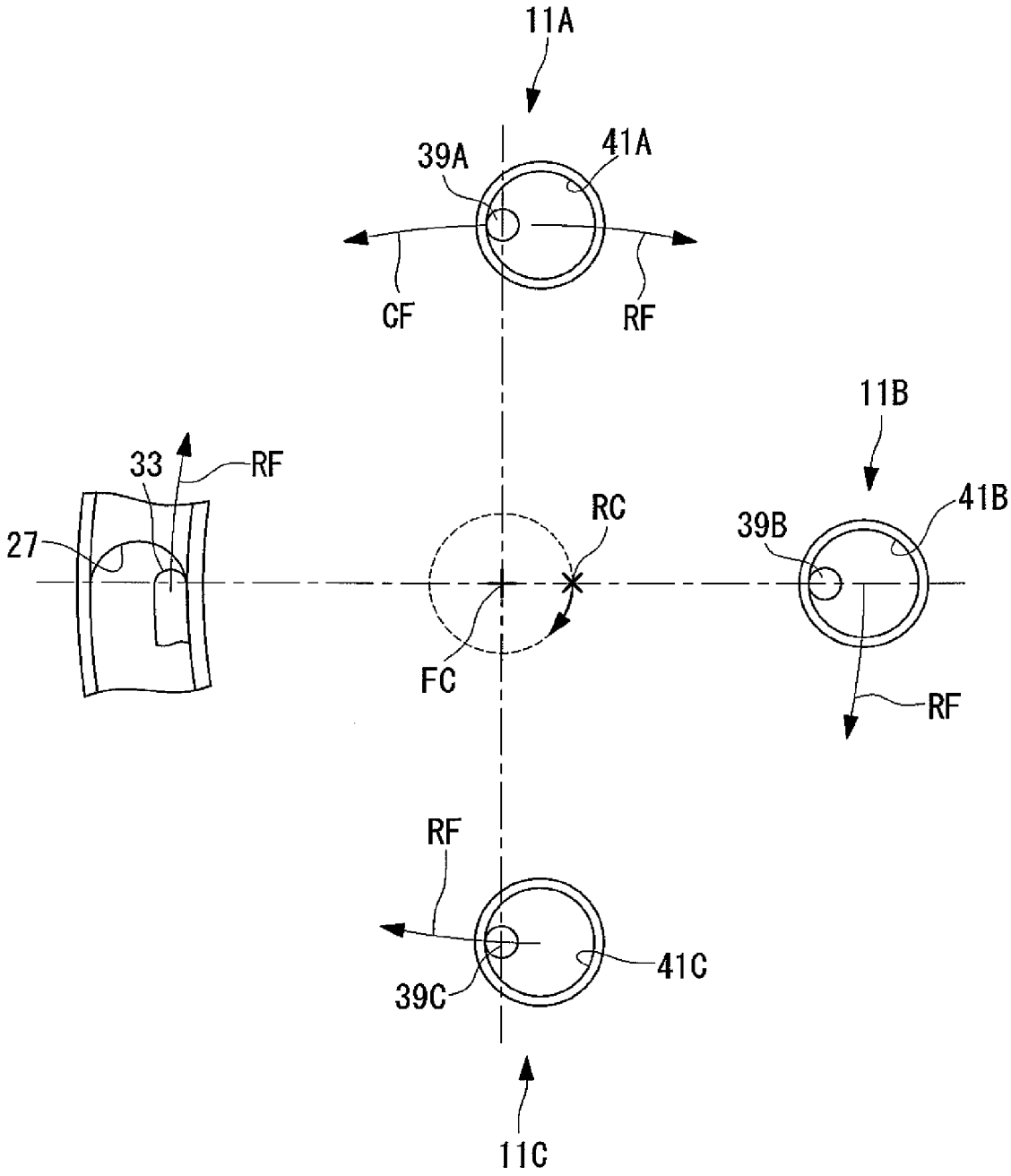
FIG. 12 is a schematic view illustrating the rotation prevention of the orbiting scroll by the step portion, the shoulder portion, and the rotation-preventing portions.

Furthermore, the case in which the orbiting scroll 7 is orbited by approximately 90° so that the center RC is located closest to the rotation-preventing portion 11B will be described with reference to FIG. 12.

In this state, the rotation-preventing force CF is generated at the rotation-preventing portion 11A. That is, since the ring 41A cannot revolve around the center RC, the rotation-preventing force CF acts on the contact portion of the ring 41A with the pin 39A. On the other hand, in the rotation-preventing portions 11B and 11C, the rings 41B and 41C can revolve by the rotation force RF around the center RC, and hence the rotation-preventing force CF is not generated. In addition, since the shoulder portion 33 has a gap with the step portion 27, the force CF preventing the rotation of the orbiting scroll 7 does not act on the shoulder portion 33.

Figure 13:
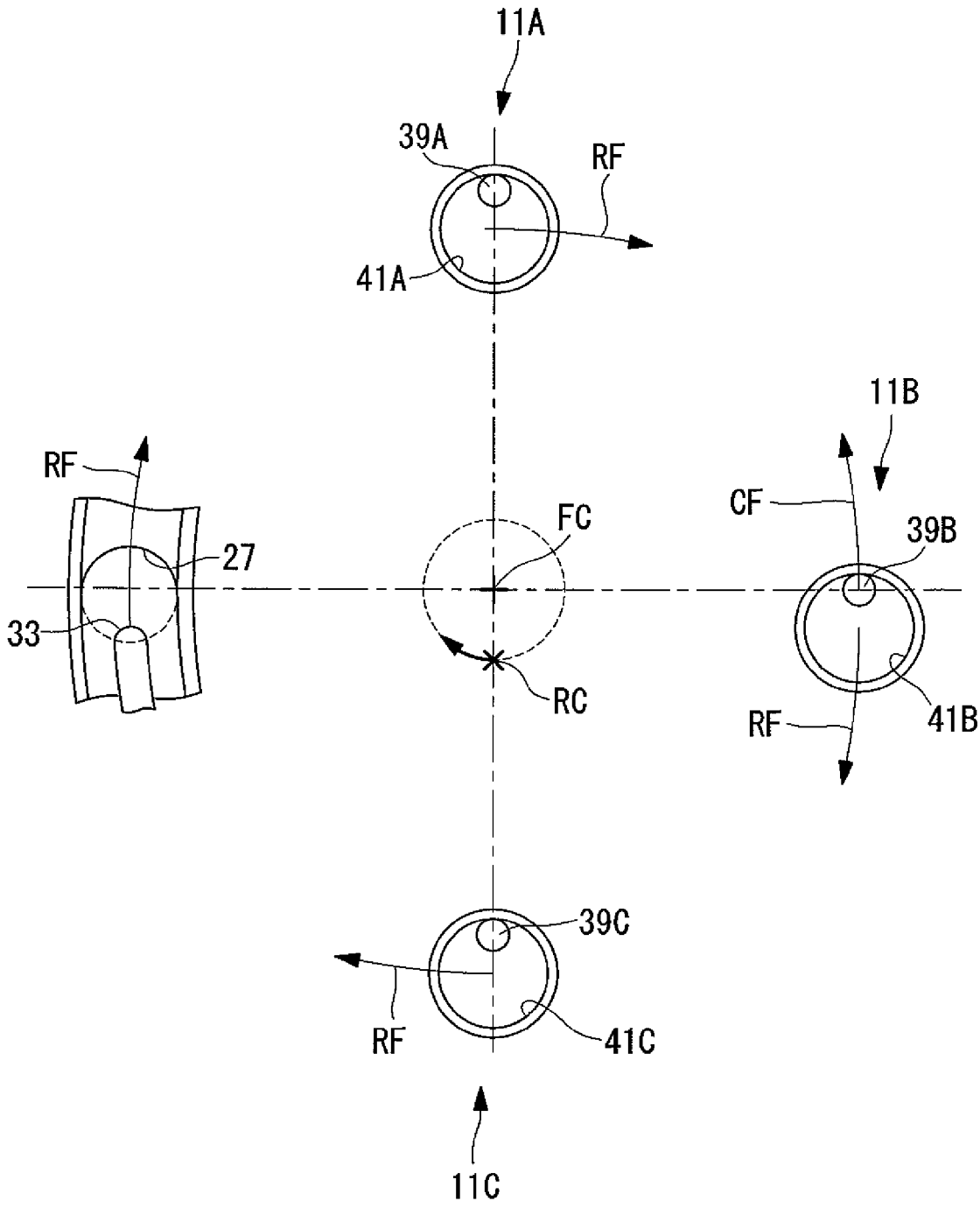
FIG. 13 is a schematic view illustrating the rotation prevention of the orbiting scroll by the step portion, the shoulder portion, and the rotation-preventing portions.

The case in which the orbiting scroll 7 is further orbited by approximately 90° from the state described above so that the center RC is located closest to the rotation-preventing portion 11C will be described with reference to FIG. 13.

In this state, the rotation-preventing force CF is generated at the rotation-preventing portion 11B. That is, since the ring 41B cannot revolve around the center RC, the rotation-preventing force CF acts on the contact portion of the ring 41B with the pin 39B. On the other hand, in the rotation-preventing portions 11A and 11C, the rings 41A and 41C can revolve by the rotation force RF around the center RC, and hence the rotation-preventing force CF is not generated. In addition, since the shoulder portion 33 has a gap with the step portion 27, the force CF preventing the rotation of the orbiting scroll 7 does not act on the shoulder portion 33.

As described above, even when the orbiting scroll 7 is located at any phase on the revolution orbit, since the rotation-preventing force CF acts on at least one of the rings 41A, 41B, and 41C and the shoulder portion 33, the rotation of the orbiting scroll 7 can be prevented.

According to the above structure, besides the rotation-preventing portions 11A, 11B, and 11C, since the shoulder portion 33 is brought into contact with the step portion 27 and slides there along, the shoulder portion 33 and the step portion 27 can prevent the rotation of the orbiting scroll 7.

When the orbiting scroll 7 is driven for revolution, it simultaneously receives the rotation force RF. This rotation direction is the spiral direction of the wall body 5*b* toward the central side (direction in which the orbiting scroll 7 revolves). The shoulder portion 33 is formed so that the height at the central side in the spiral direction is small and that at the exterior end side is great, and the step portion 27 is formed so that the height at the central side in the spiral direction is great and that at the exterior end side is small. According to the structure, when the orbiting scroll 7 is to rotate in the above rotation direction, the shoulder portion 33 and the step portion 27 are brought into contact with each other, and hence the rotation of the orbiting scroll 7 can be prevented.

Since the phase at which the shoulder portion 33 is disposed with respect to the center RC of the orbiting scroll 7 is different from the phases at which the rotation-preventing portions 11A, 11B, and 11C are disposed, the number of places at which the rotation-preventing portions 11A, 11B, and 11C are disposed can be decreased, and hence the manufacturing cost can be reduced.

As described above, since the shoulder portion 33 and the step portion 27 can prevent the rotation of the orbiting scroll 7, they can share the role of the rotation-preventing portions 11A, 11B, and 11C. In particular, when the phase at which the shoulder portion 33 is disposed with respect to the center RC of the orbiting scroll 7 is made different from the phases at which the rotation-preventing portions 11A, 11B, and 11C are disposed, the shoulder portion 33 and the step portion 27 can serve the same function as that of a rotation-preventing portion which is to be disposed at the place at which the shoulder portion 33 is disposed, and hence the above rotation-preventing portion can be omitted. Hence, the number of places at which the rotation-preventing portions 11A, 11B, and 11C are disposed can be decreased, and as a result, the manufacturing can be reduced.

The shoulder portion 33 and the rotation-preventing portions 11A, 11B, and 11C are disposed at approximately equivalent phase intervals, and hence the rotation-preventing performance for the orbiting scroll 7 can be further improved.

The rotation of the orbiting scroll 7 can be prevented by the shoulder portion 33 and the rotation-preventing portions 11A, 11B, and 11C only when the orbiting scroll 7 is at a predetermined eccentric phase with respect to the phase of the shoulder portion 33 or that of the rotation-preventing portion 11A, 11B, or 11C. Hence, when the shoulder portion 33 and the rotation-preventing portions 11A, 11B, and 11C are disposed at approximately equivalent phase intervals, the rotation of the orbiting scroll 7 can be uniformly prevented, and as a result, the rotation-preventing performance can be further improved.

Figure 14:
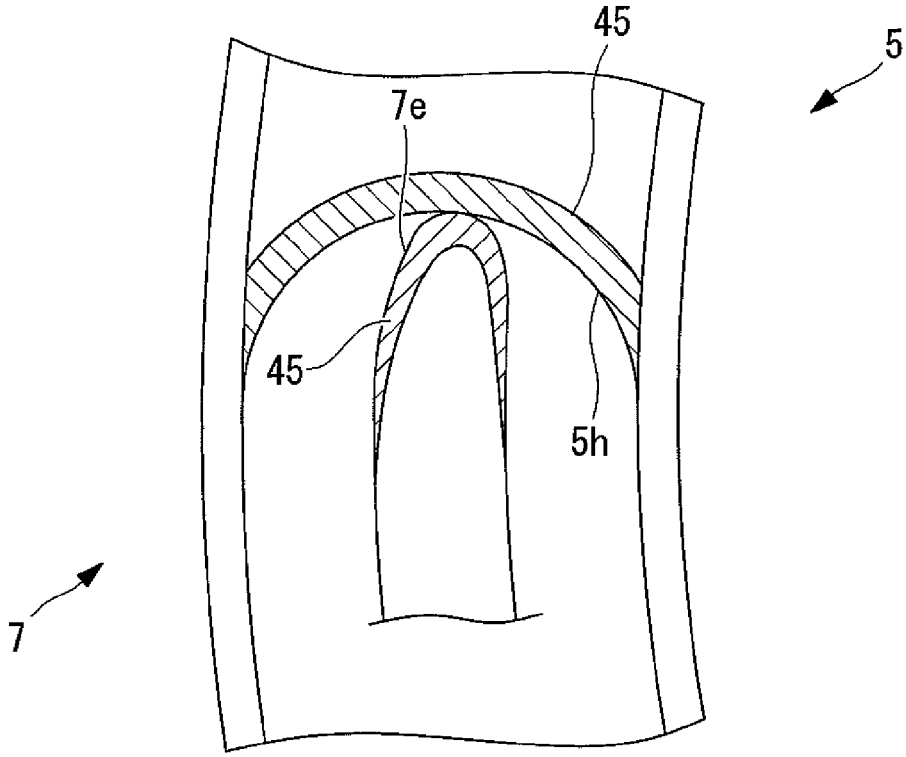
FIG. 14 is a view illustrating another example of a connection wall surface and a connection edge shown in FIGS. 2 and 3.
Figure 15:
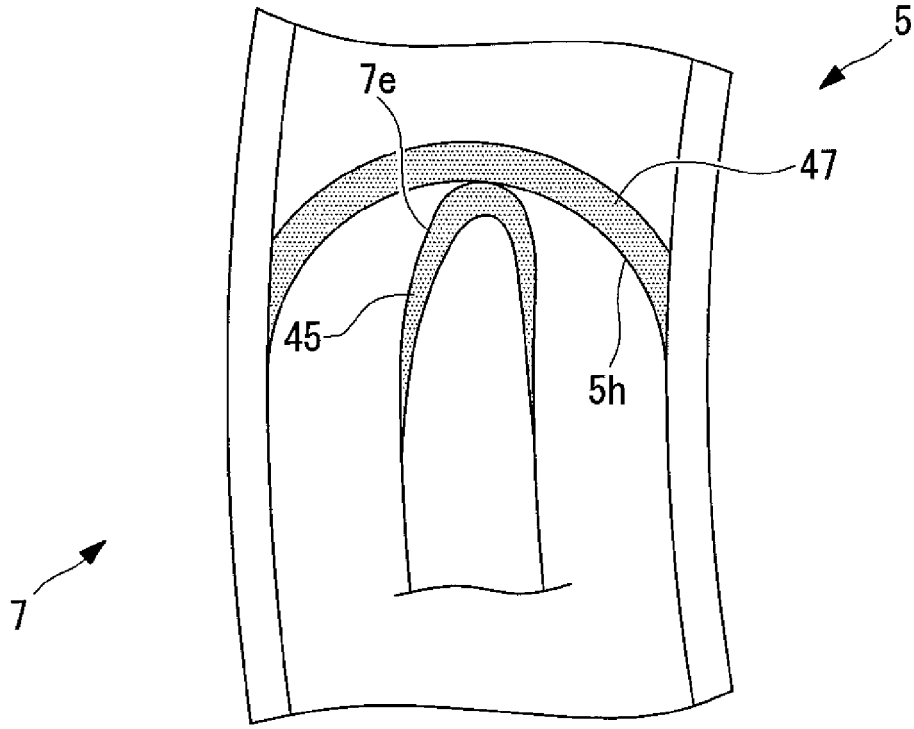
FIG. 15 is a view illustrating still another example of the connection wall surface and the connection edge shown in FIGS. 2 and 3.

FIG. 14 is a view illustrating another example of the connection wall surface 5*h* in FIG. 2 and the connection edge 7*e* shown in FIG. 3. FIG. 15 is a view illustrating still another example of the connection wall surface 5*h* in FIG. 2 and the connection edge 7*e* shown in FIG. 3.

The surface of the connection wall surface (end plate step portion) 5*h* forming the step portion 27 and the surface of the connection edge (end plate shoulder portion) 7*e* forming the shoulder portion 33 may not be processed at all or may be processed to improve abrasion resistance, and hence a surface treatment therefor may be performed whenever necessary.

For example, when the fixed scroll 5 and the orbiting scroll 7 are formed from an alloy, hardened parts (surface treatment layers) 45 formed by high-frequency hardening may be provided on the connection wall surface 5*h*, the connection edge 7*e*, and the vicinities thereof, as shown in FIG. 14. Alternatively, coating layers (surface treatment layers) 47 formed by ceramic coating or diamond-like-carbon (DLC) coating may be provided on the connection wall surface 5*h*, the connection edge 7*e*, and the vicinities thereof, as shown in FIG. 15.

By the structure as described above, since the hardened parts 45 or the coating layers 47 are provided on the connection edge 7*e* and the connection wall surface 5*h*, the degradation in rotation-preventing performance for the orbiting scroll 7 can be prevented.

In order to improve the abrasion resistance, since the hardened parts 45 or the coating layers 47 are provided on the contact portion of the connection edge 7*e* with the connection wall surface 5*h* and the contact portion of the connection wall surface 5*h* with the connection edge 7*e*, the degradation in abrasion resistances of the contact portion of the connection edge 7*e* and that of the connection wall surface 5*h* can be prevented. Since the abrasion is prevented, the contact state between the connection edge 7*e* and the connection wall surface 5*h* can always be maintained constant, and as a result, the degradation in rotation-preventing performance, which is caused by the connection edge 7*e* and the connection wall surface 5*h*, can be prevented.

Figure 16:
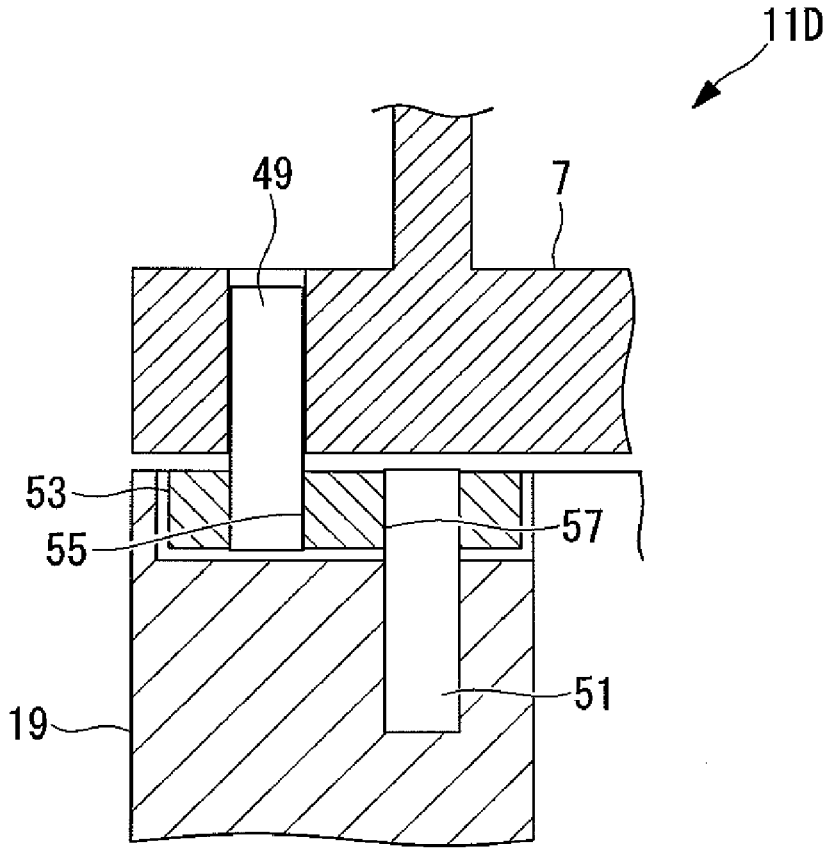
FIG. 16 is a cross-sectional view illustrating another example of the rotation-preventing portion shown in FIG. 5.
Figure 17:
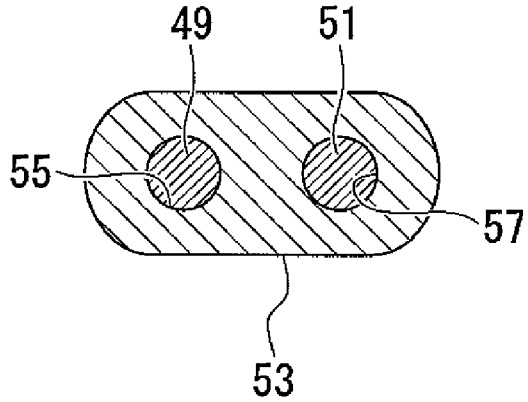
FIG. 17 is a view illustrating the structure of the rotation-preventing portion shown in FIG. 16.
Figure 18:
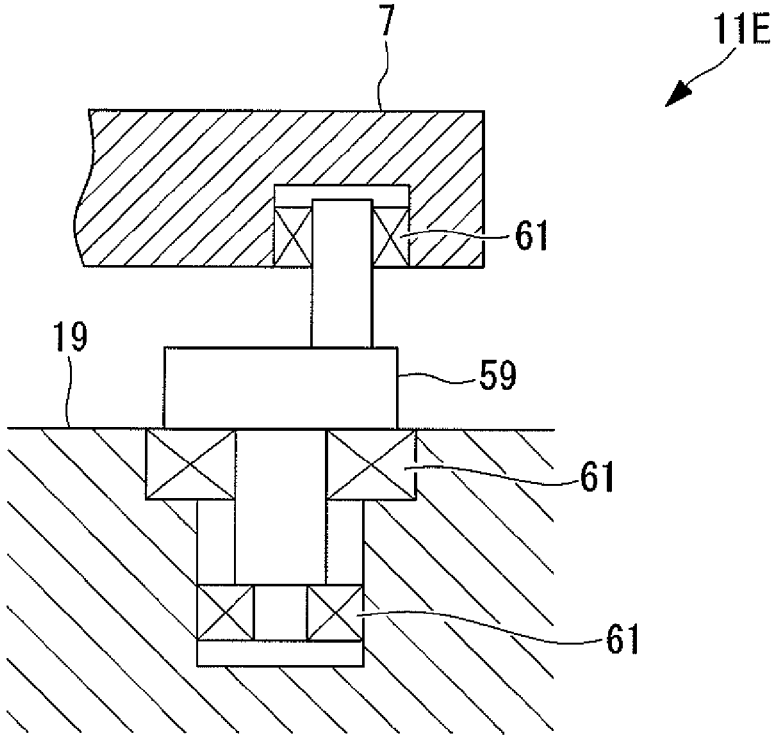
FIG. 18 is a cross-sectional view illustrating yet another example of the rotation-preventing portion shown in FIG. 5.

FIG. 16 is a cross-sectional view illustrating another example of the rotation-preventing portion shown in FIG. 5. FIG. 17 is a view illustrating the structure of the rotation-preventing portion shown in FIG. 16. FIG. 18 is a cross-sectional view illustrating still another example of the rotation-preventing portion shown in FIG. 5.

The rotation-preventing portion 11 formed of one pin 39 and one ring 41 may be used, as described above; a rotation-preventing portion 11D formed of two pins and a restricting member corresponding to the ring may be used, as shown n FIG. 16; and a rotation-preventing portion 11E formed of one eccentric pin and a rotation support portion such as a plurality of bearings may by used, as shown n FIG. 18. Hence, the structure of the rotation-preventing portion is not particularly limited.

As shown in FIG. 16, the rotation-preventing portion 11D has an orbiting-side pin 49 provided in the orbiting scroll 7, a fixing-side pin 51 provided in the frame 19, and a restricting member 53. In the restricting member 53, as shown in FIG. 17, an orbiting hole 55 through which the orbiting-side pin 49 is inserted and a fixing hole 57 through which the fixing-side pin 51 is inserted are formed.

As shown in FIG. 18, the rotation-preventing portion 11E has an eccentric pin 59 and rotation support portions 61. The rotation support portions 61 are disposed between the eccentric pin 59 and the frame 19 and between the eccentric pin 59 and the orbiting scroll 7.

As described above, the shoulder portion 33 of the orbiting scroll 7 may be disposed at a lower side, and the step portion 27 of the fixed scroll 5 may be disposed at an upper side, and conversely, the shoulder portion 33 of the orbiting scroll 7 may be disposed at an upper side, and the step portion 27 of the fixed scroll 5 may be disposed at a lower side; hence, the positions described above are not particularly limited.

When the placement is performed as described above, in the vicinity of the surface at the outer circumferential side of the step portion 27, a lubricant remains due to gravity, the flow of a fluid, and the like. The shoulder portion 33 scrapes the above lubricant by the revolving motion of the orbiting scroll 7, and a contact surface between the shoulder portion 33 and the step portion 27 is forced-fed with the lubricant. Since the contact surface between the shoulder portion 33 and the step portion 27 is forced-fed with the lubricant, abrasion and seizure are prevented, and the degradation in rotation-preventing performance for the orbiting scroll 7 can be prevented.

The present invention has been described using a vertical type scroll compressor; however, the present invention is not limited thereto and may be applied to a horizontal type scroll compressor. When the present invention is applied to a horizontal type scroll compressor, the shoulder portion 33 of the orbiting scroll 7 and the step portion 27 of the fixed scroll 5 are preferably disposed at a lower side.

When the placement is performed as described above, in a region in the vicinities of the shoulder portion 33 of the orbiting scroll 7 and the step portion 27 of the fixed scroll 5, a lubricant remains due to gravity, the flow of a fluid, and the like. The shoulder portion 33 scrapes the above lubricant by the revolving motion of the orbiting scroll 7, and the contact surface between the shoulder portion 33 and the step portion 27 is forced-fed with the lubricant. Since the contact surface between the shoulder portion 33 and the step portion 27 is forced-fed with the lubricant, abrasion and seizure are prevented, and the degradation in rotation-preventing performance for the orbiting scroll 7 can be prevented.

As described above, the three rotation-preventing portions 11A, 11B, and 11C may be disposed in the scroll compressor 1, or at least three, such as five or seven, rotation-preventing portions may also be disposed, and the number of the rotation-preventing portions is not particularly limited.

Second Embodiment

Figure 24:
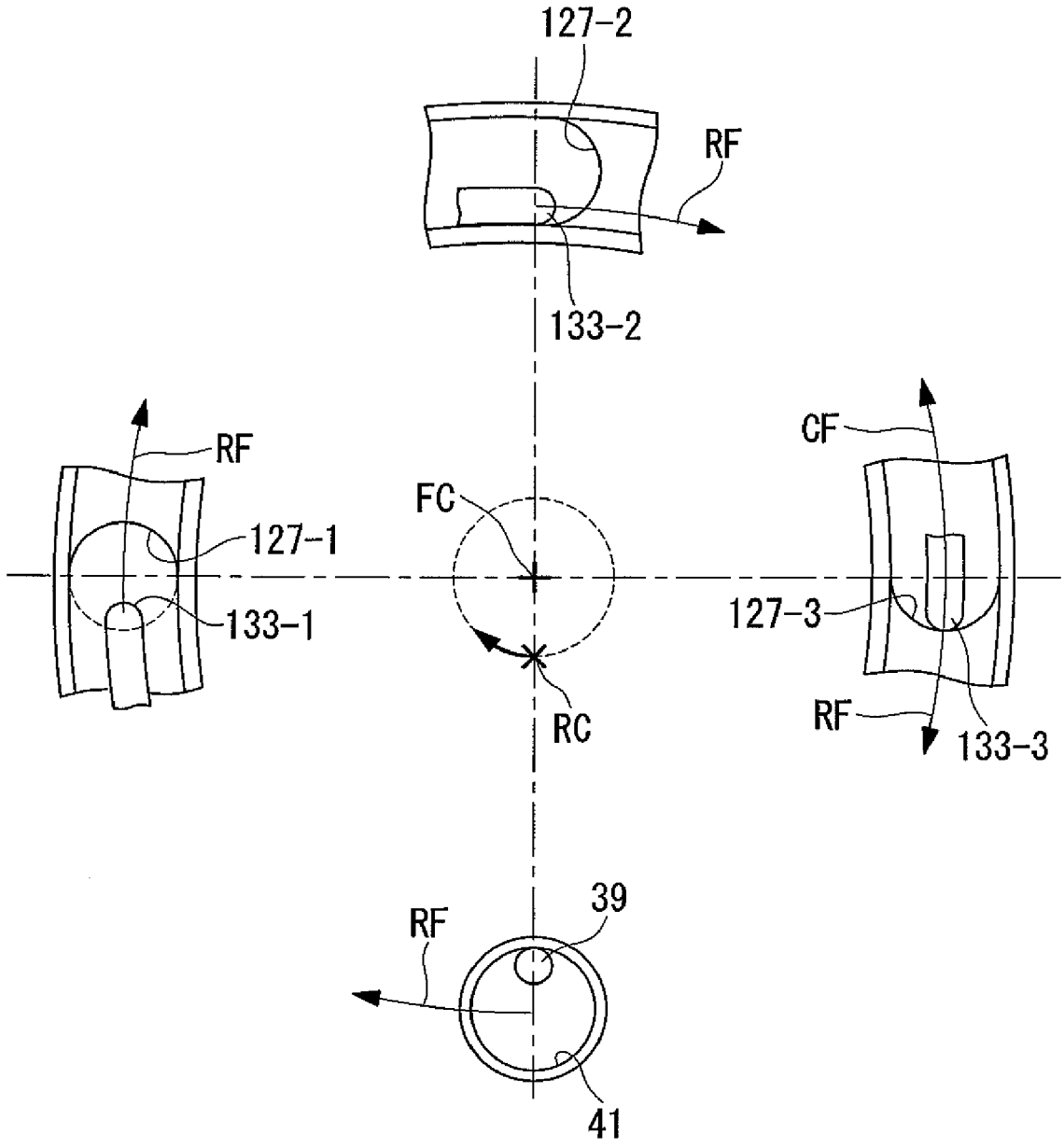
FIG. 24 is a schematic view illustrating the rotation prevention of the orbiting scroll by the step portion, the shoulder portion, and the rotation-preventing portions.

Next, a second embodiment of the present invention will be described with reference to FIGS. 19 and 24.

The basic structure of the scroll compressor of this embodiment is substantially equivalent to that in the first embodiment, except that the structures of a fixed scroll and an orbiting scroll and the placement of rotation-preventing portions are different from those in the first embodiment. Hence, in this embodiment, with reference to FIGS. 19 to 24, the structures of the fixed and the orbiting scrolls, the placement of rotation-preventing portions, and the vicinities thereof will only be described, and descriptions of the other constituent elements and the like will be omitted.

Figure 19:
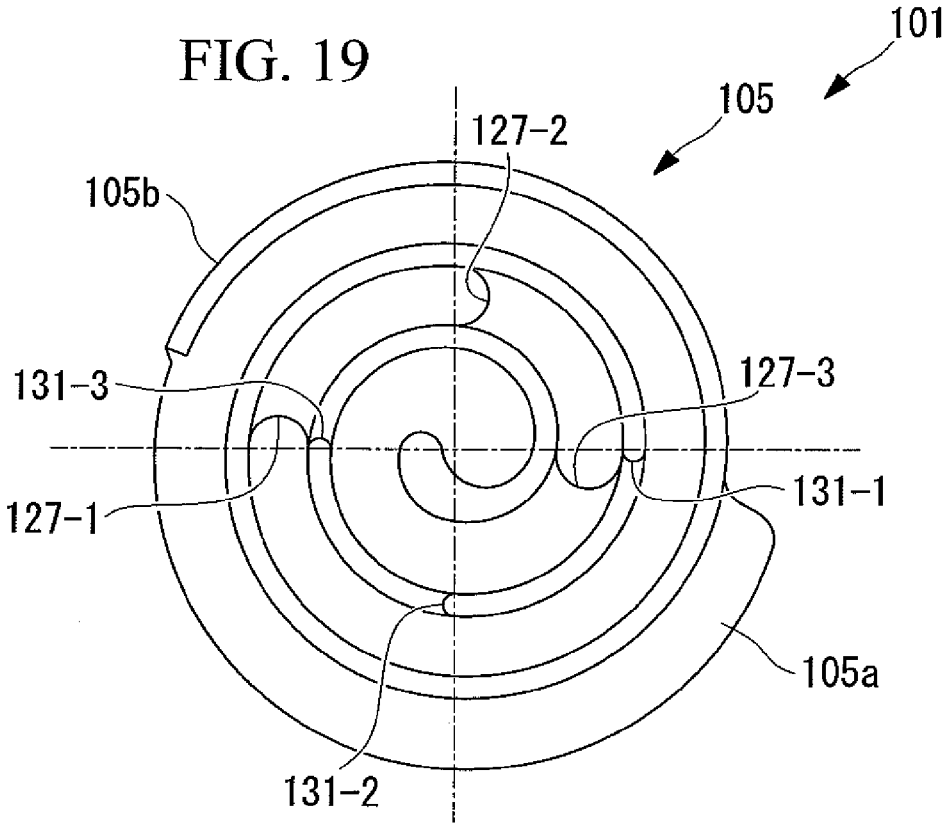
FIG. 19 is a view illustrating the structure of a fixed scroll of a scroll compressor according to a second embodiment of the present invention.
Figure 20:
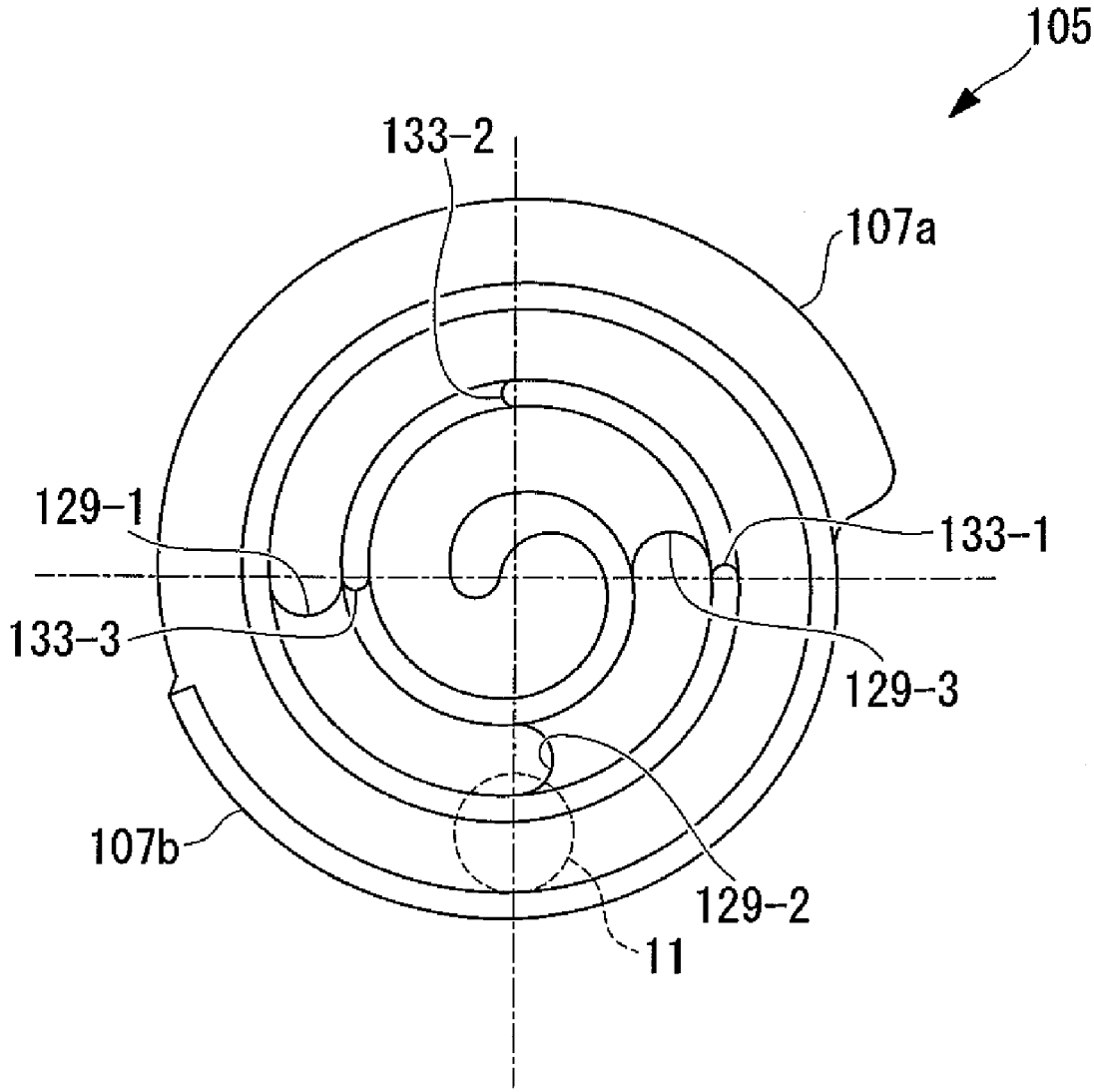
FIG. 20 is a view illustrating the structure of an orbiting scroll of the scroll compressor according to the second embodiment of the present invention.

FIG. 19 is a view illustrating the structure of the fixed scroll of the scroll compressor according to this embodiment. FIG. 20 is a view illustrating the structure of the orbiting scroll of the scroll compressor according to this embodiment.

In this embodiment, the same reference numerals as in the first embodiment designate the same constituent elements in this embodiment, and descriptions thereof will be omitted.

As shown in FIG. 19, a fixed scroll 105 of a scroll compressor 101 is formed of a first end plate 105*a* and a spiral first wall body 105*b* vertically provided on one surface thereof. In addition, as is the fixed scroll 105, an orbiting scroll 107 is formed of a second end plate 107*a* and a second spiral wall body 107*a* vertically provided on one surface thereof, as shown in FIG. 20. The orbiting scroll 107 is eccentric with respect to the fixed scroll 105 by a revolution radius r and is disposed apart from the fixed scroll 105 by 180° in terms of the phase shift. In this state, the orbiting scroll 107 and the fixed scroll 105 are assembled so that the wall bodies 105*b* and 107*b* are engaged with each other.

The end plate 105*a* of the fixed scroll 105 is formed to have step portions (end-plate step portions) 127-1, 127-2, and 127-3 on the surface on which the wall body 105*b* is vertically provided so that along the spiral direction of the wall body 105*b*, the heights of the step portions are great at a central side and are small at an exterior end side. In addition, as the end plate 105*a* of the fixed scroll 105, the end plate 107*a* of the orbiting scroll 107 is formed to have step portions (end-plate step portions) 129-1, 129-2, and 129-3 on the surface on which the wall body 107*b* is vertically provided so that along the spiral direction of the wall body 107*b*, the heights of the step portions are great at a central side and are small at an exterior end side.

The wall body 105*b* of the fixed scroll 105 has shoulder portions 131-1, 131-2, and 131-3 at positions corresponding to the step portions 129-1, 129-2, and 129-3 of the orbiting scroll 107, and the heights of the shoulder portions are small at the central side and are great at the exterior end side along the spiral direction of the wall body 105*b*. In addition, as the wall body 105*b*, the wall body 107*b* of the orbiting scroll 107 has shoulder portions (wall body shoulder portions) 133-1, 133-2, and 1331-3 at positions corresponding to the step portions 127-1, 127-2, and 127-3 of the fixed scroll 105, and the heights of the above shoulder portions are small at the central side and are great at the exterior end side along the spiral direction of the wall body 107*b*.

As shown in FIG. 20, the rotation-preventing portion 11 allows the orbiting scroll 107 to revolve and, at the same time, prevents the rotation of the orbiting scroll 107. In this embodiment, the rotation-preventing portion 11 is provided at one place. The rotation-preventing portion 11 is provided together with the three shoulder portions 133-1, 133-2, and 133-3 of the orbiting scroll 107 at phase intervals of approximately 90° with respect to the center of the orbiting scroll 107.

Next, the operation of the scroll compressor 101 having the above structure will be described.

Since the compression of a fluid by the scroll compressor 101 is approximately equivalent to that in the first embodiment, description thereof will be omitted.

Next, the operation of the rotation prevention of the orbiting scroll, which is a feature of this embodiment, will be described.

FIGS. 21 to 24 are schematic views illustrating the rotation prevention of the orbiting scroll by the step portions and shoulder portions, and the rotation-preventing portion. These figures are views showing the scroll compressor when the fixed scroll side is viewed from the rotating shaft side.

Figure 21:
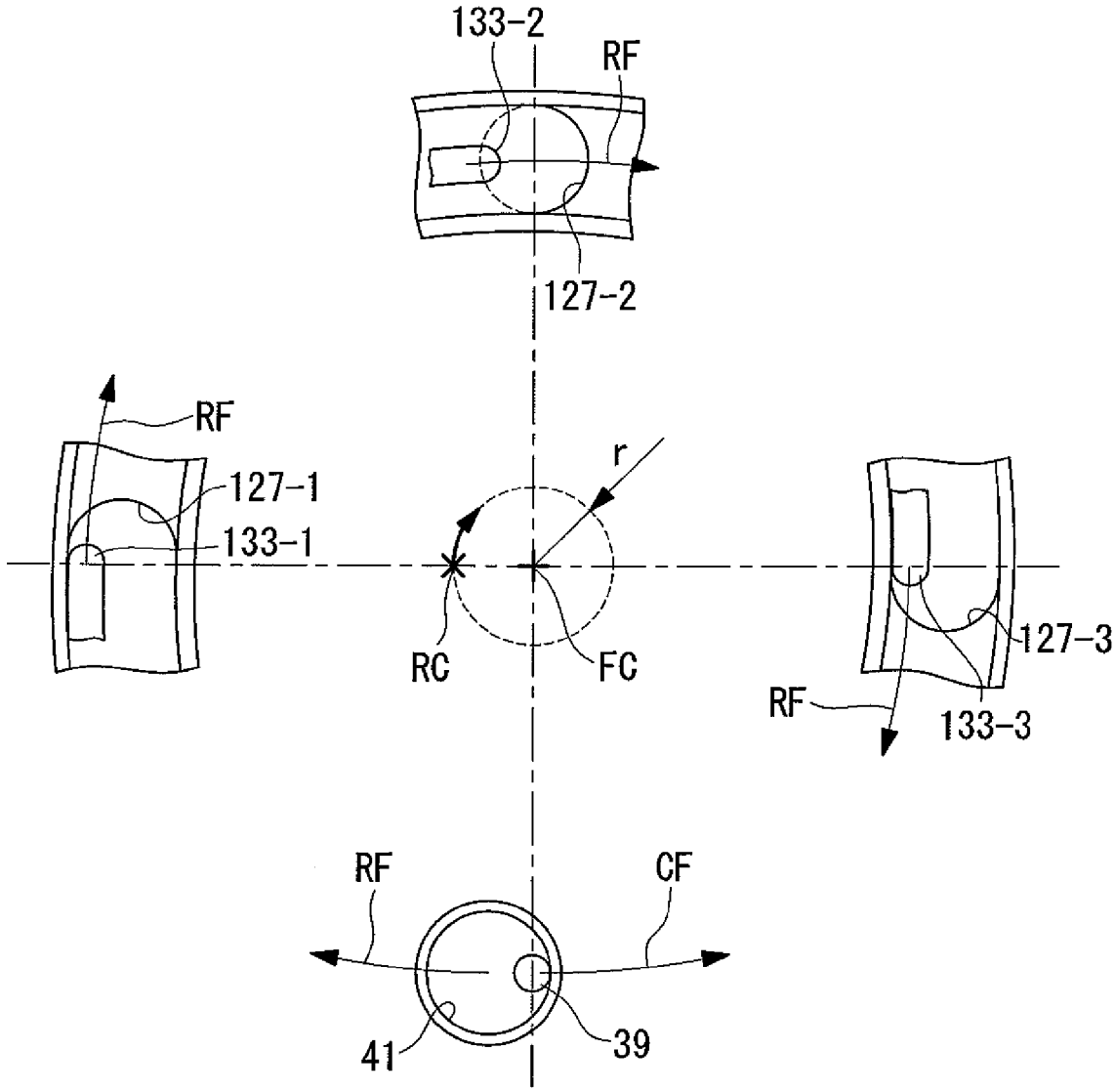
FIG. 21 is a schematic view illustrating the rotation prevention of an orbiting scroll by a step portion, a shoulder portion, and rotation-preventing portions.

In FIG. 21, the center RC of the orbiting scroll 107 is located at a place closest to the step portion 127-1. In this state, when a force RF rotating the orbiting scroll 107 acts on the ring 41, and the shoulder portions 133-1, 133-2, and 133-3, a force CF preventing the rotation of the orbiting scroll 107 acts only on the rotation-preventing portion 11 including the ring 41. That is, since there are spaces between the step portions 127-1, 127-2, and 127-3 and the respective shoulder portions 133-1, 133-2, and 133-3, as the rotation force RF acts thereon, the shoulder portions 133-1, 133-2, and 133-3 can be moved; hence, the force CF preventing the rotation of the orbiting scroll 107 does not act thereon. On the other hand, the center of the ring 41 is located on the line along which the rotation force RF acts on the pin 39 and at a position opposite to the direction of the force RF. Hence, even when the rotation force RF acts on the ring 41, it cannot revolve around the center RC. That is, the rotation-preventing force CF acts on the contact portion of the ring 41 with the pin 39.

Figure 22:
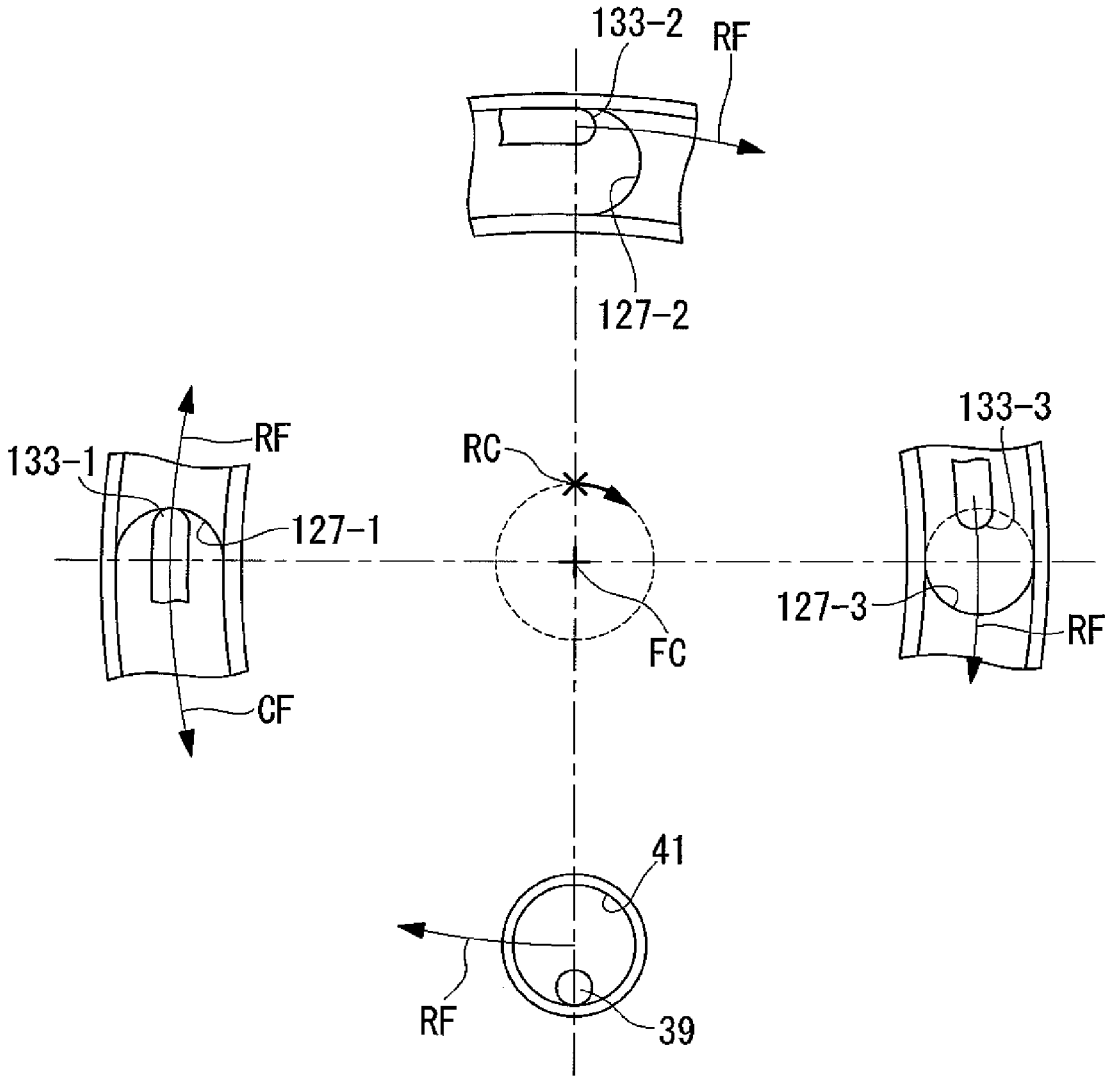
FIG. 22 is a schematic view illustrating the rotation prevention of the orbiting scroll by the step portion, the shoulder portion, and the rotation-preventing portions.

Next, the case in which the orbiting scroll 107 is orbited by approximately 90° so that the center RC is located closest to the step portion 127-2 will be described with reference to FIG. 22.

In this state, by the rotation force RF, the shoulder portion 133-1 and the step portion 127-1 are brought into contact with each other, and hence the rotation-preventing force CF acts on the contact portion of the shoulder portion 133-1 with the step portion 127-1. Since there are spaces between the step portions 127-2 and 127-3 and the respective shoulder portions 133-2 and 133-3, as the rotation force RF acts thereon, the shoulder portions 133-2 and 133-3 can be moved; hence, the force CF preventing the rotation of the orbiting scroll 107 does not act thereon. In addition, in the rotation-preventing portion 11, the ring 41 can revolve around the center RC by the rotation force RF, and hence the rotation-preventing force CF is not generated.

Figure 23:
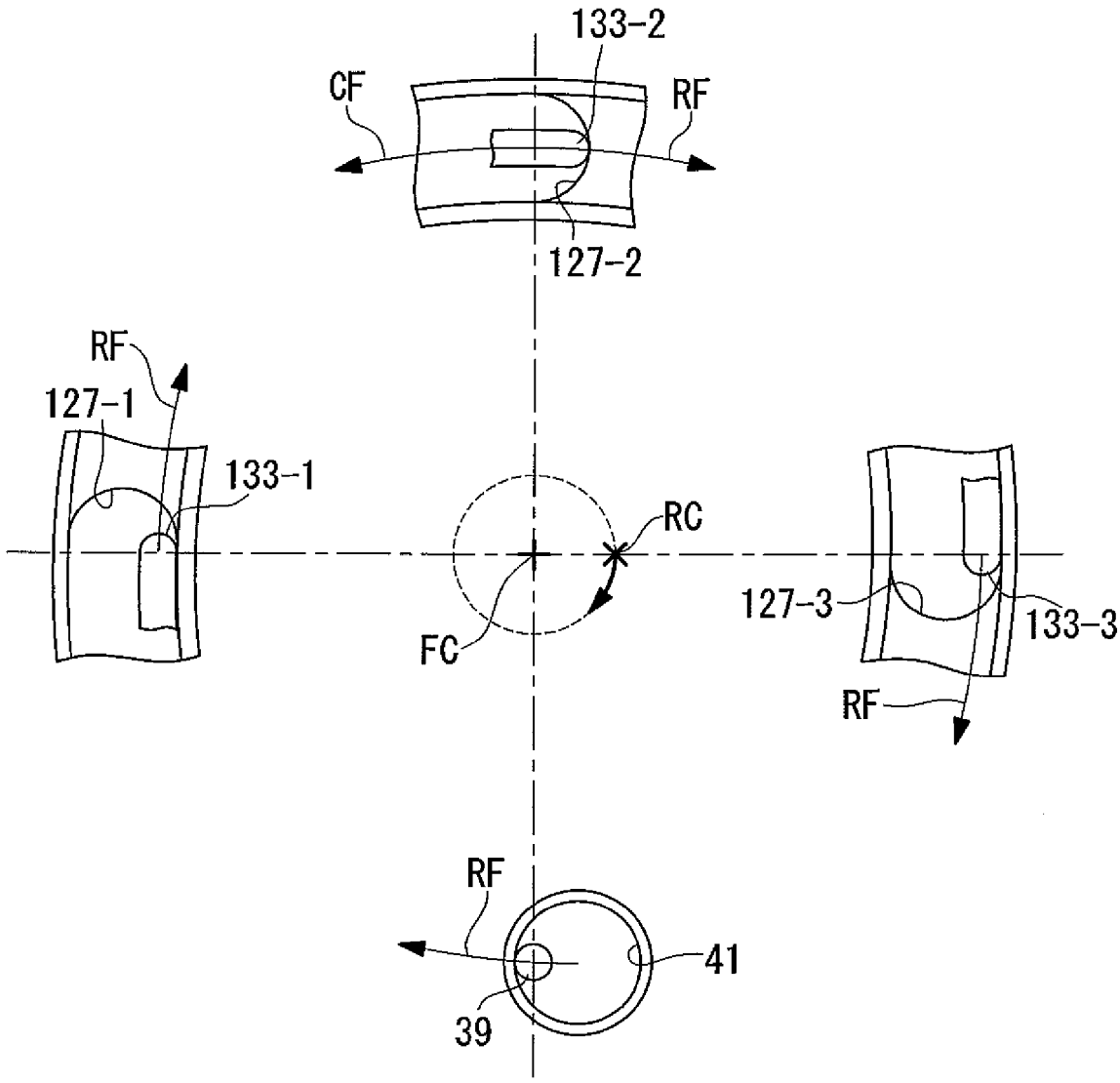
FIG. 23 is a schematic view illustrating the rotation prevention of the orbiting scroll by the step portion, the shoulder portion, and the rotation-preventing portions.

The case in which the orbiting scroll 107 is further orbited by approximately 90° so that the center RC is located closest to the step portion 127-3 will be described with reference to FIG. 23.

In this state, by the rotation force RF, the shoulder portion 133-2 and the step portion 127-2 are brought into contact with each other, and hence the rotation-preventing force CF acts on the contact portion of the shoulder portion 133-2 with the step portion 127-2. Since there are spaces between the step portion 127-1 and 127-3 and the respective shoulder portions 133-1 and 133-3, as the rotation force RF acts thereon, the shoulder portions 133-1 and 133-3 can be moved; hence, the force CF preventing the rotation of the orbiting scroll 107 does not act thereon. In addition, in the rotation-preventing portion 11, the ring 41 can revolve around the center RC by the rotation force RF, and hence the rotation-preventing force CF is not generated.

The case in which the orbiting scroll 107 is further orbited by approximately 90° from the above state so that the center RC is located closest to the rotation-preventing portion 11 will be described with reference to FIG. 24.

In this state, by the rotation force RF, the shoulder portion 133-3 and the step portion 127-3 are brought into contact with each other, and hence the rotation-preventing force CF acts on the contact portion of the shoulder portion 133-3 with the step portion 127-3. Since there are spaces between the step portions 127-1 and 127-2 and the respective shoulder portions 133-1 and 133-2, as the rotation force RF acts thereon, the shoulder portions 133-1 and 133-2 can be moved; hence, the force CF preventing the rotation of the orbiting scroll 107 does not act thereon. In addition, in the rotation-preventing portion 11, the ring 41 can revolve around the center RC by the rotation force RF, and hence the rotation-preventing force CF is not generated.

As described above, even when the orbiting scroll 107 is located at any phase on the revolution orbit, since the rotation-preventing force CF acts on at least one of the ring 41 and the shoulder portions 133-1, 133-2, and 133-3, the rotation of the orbiting scroll 107 is prevented.

According to the structure described above, the shoulder portions 133-1, 133-2, and 133-3 and the step portions 127-1, 127-2, and 127-3 are provided at a plurality of places, the manufacturing cost of the scroll compressor 101 can be reduced.

When the shoulder portions 133-1, 133-2, and 133-3 and the step portions 127-1, 127-2, and 127-3 are provided, the rotation-preventing function for the orbiting scroll 107 can be shared by the shoulder portions 133-1, 133-2, and 133-3 and the step portions 127-1, 127-2, and 127-3, and as a result, the number of the rotation-preventing portions 11 which are each formed of the pin 39 and the ring 41 can be decreased. Since the number of the rotation-preventing portions 11 is decreased, the manufacturing cost of the scroll compressor 101 can be reduced.

Third Embodiment

Next, a third embodiment of the present invention will be described with reference to FIGS. 25 and 28.

A basic structure of a scroll compressor of this embodiment is substantially equivalent to that in the first embodiment, except that the structures of a fixed scroll and an orbiting scroll are different from those in the first embodiment. Hence, in this embodiment, with reference to FIGS. 25 to 28, only the fixed scroll, the orbiting scroll, and the vicinities thereof will be described, and description of the other constituent elements will be omitted.

Figure 25:
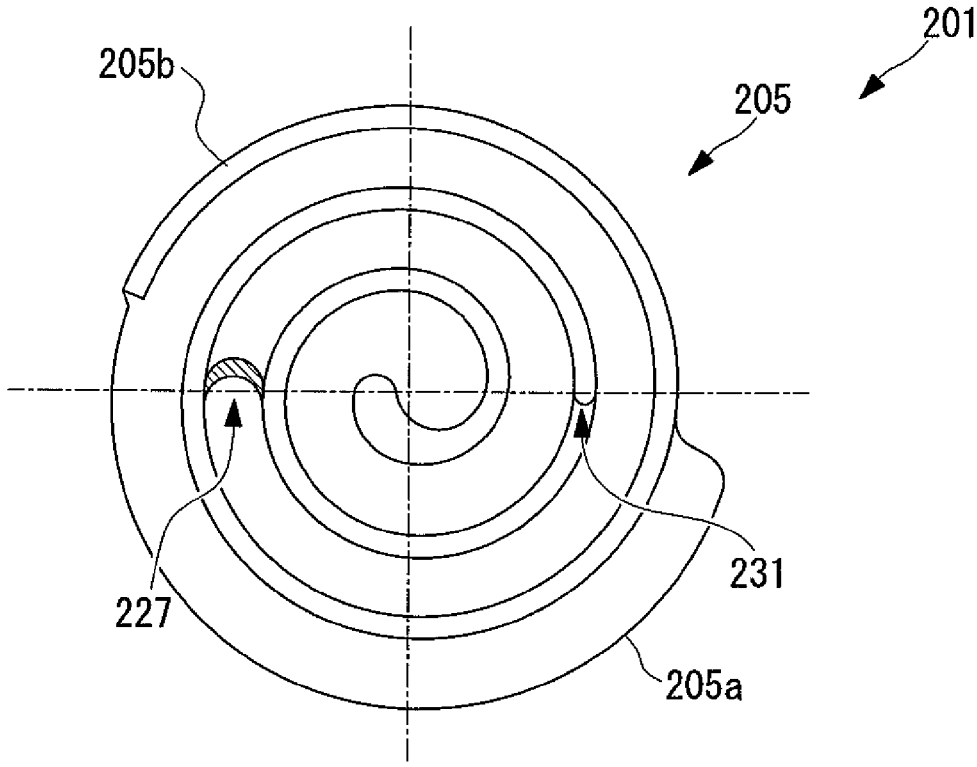
FIG. 25 is a view illustrating the structure of a fixed scroll of a scroll compressor according to a third embodiment of the present invention.
Figure 26:
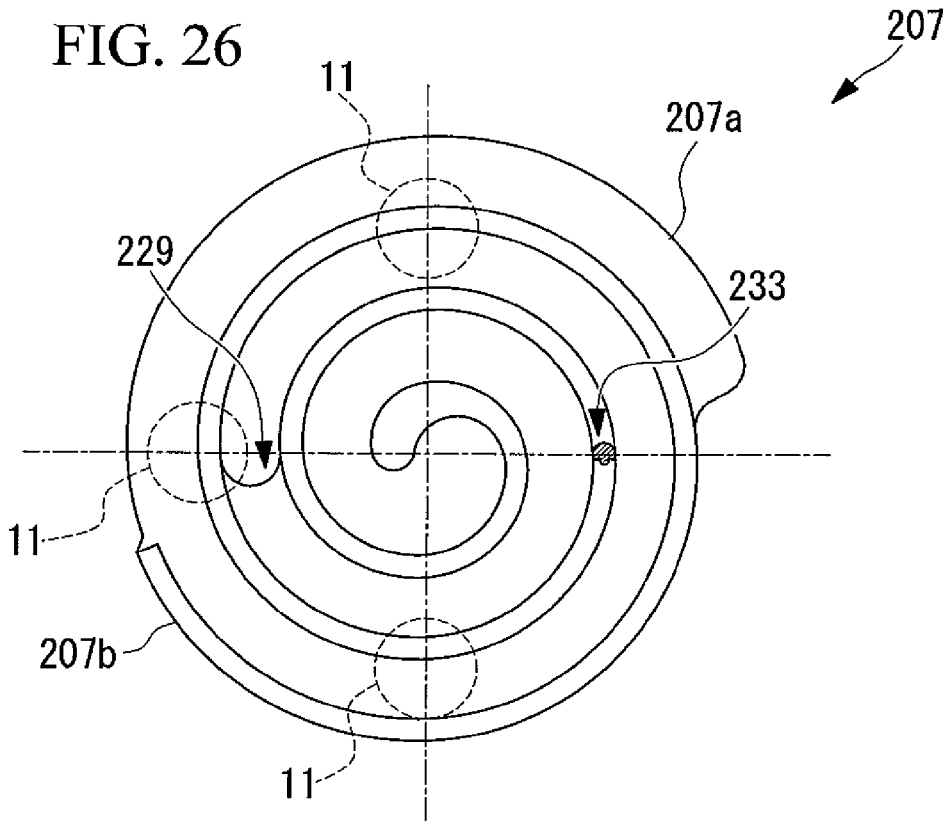
FIG. 26 is a view illustrating the structure of an orbiting scroll of the scroll compressor according to the third embodiment of the present invention.

FIG. 25 is a view illustrating the structure of the fixed scroll of the scroll compressor according to this embodiment. FIG. 26 is a view illustrating the structure of the orbiting scroll of the scroll compressor according to this embodiment.

In this embodiment, the same reference numerals as in the first embodiment designate the same constituent elements in this embodiment, and descriptions thereof will be omitted.

As shown in FIG. 25, a fixed scroll 205 of a scroll compressor 201 is formed of a first end plate 205*a* and a spiral first wall body 205*b* vertically provided on one surface thereof. In addition, as is the fixed scroll 205, an orbiting scroll 207 is formed of a second end plate 207*a* and a second spiral wall body 207*b* vertically provided on one surface thereof, as shown in FIG. 26. The orbiting scroll 207 is eccentric with respect to the fixed scroll 205 by a revolution radius r and is disposed apart from the fixed scroll 205 by 180. degree. in terms of the phase shift. In this state, the orbiting scroll 207 and the fixed scroll 205 are assembled so that the wall bodies 205*b* and 207*b* are engaged with each other.

As shown in FIG. 25, the end plate 205*a* of the fixed scroll 205 is formed to have a step portion (end-plate step portion) 227 on the surface on which the wall body 205*b* is vertically provided so that along the spiral direction of the wall body 205*b*, the height of the step portion 227 is great at a central side and is small at an exterior end side. In addition, as the end plate 205*a* of the fixed scroll 205, as shown in FIG. 26, the end plate 207*a* of the orbiting scroll 207 is formed to have a step portion 229 on the surface on which the wall body 207*b* is vertically provided so that along the spiral direction of the wall body 207*b*, the height of the step portion 229 is great at a central side and is small at an exterior end side.

Figure 27:
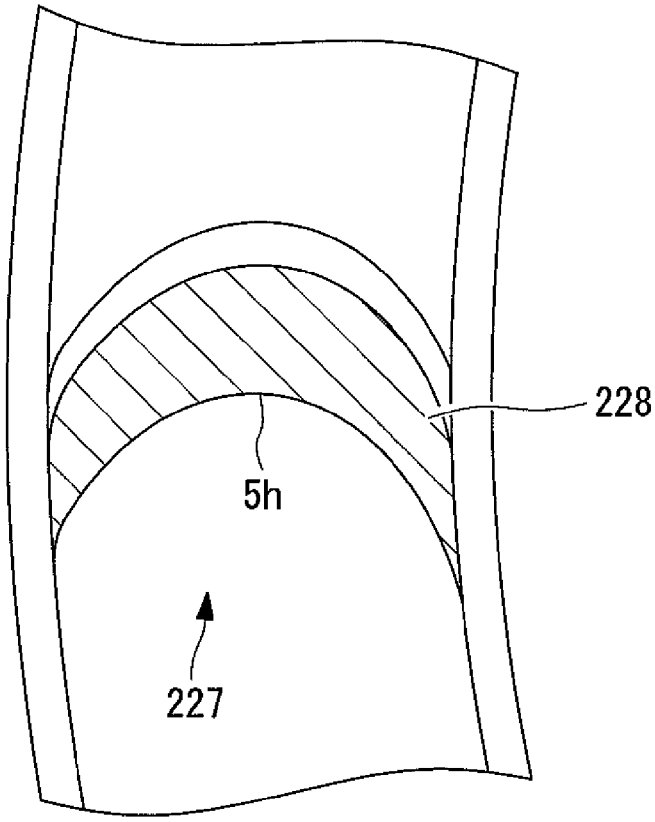
FIG. 27 is a partially enlarged view illustrating the structure of a step portion of the fixed scroll shown in FIG. 25.

FIG. 27 is a partial enlarged view illustrating the structure of the step portion of the fixed scroll shown in FIG. 25.

As shown in FIG. 27, an end-plate contact portion 228, which is made of an abrasion-resistant metal, a ceramic, or the like, is detachably provided for the step portion 227. The end-plate contact portion 228 is brought into contact with a wall-body contact portion 234 provided on a shoulder portion 233 to slide there along and serves to prevent the abrasion of the step portion 227. On the end-plate contact portion 228, the connection wall surface 5*h* which slides along the wall-body contact portion 234 is formed.

Since the end-plate contact portion 228 is pressed to the end plate 205*a* when it is brought into contact with the wall-body contact portion 234 on the shoulder portion 233 and slides there along, it is not necessary to fix the end-plate contact portion 228 to the end plate 205*a* with an adhesive or the like.

As shown in FIG. 25, the wall body 205*b* of the fixed scroll 205 has a shoulder portion 231 at a place corresponding to the step portion 229 of the orbiting scroll 207, the height of the shoulder portion 231 being small at a central side along the spiral direction of the wall body 205*b* and being great at an exterior end side. In addition, as the wall body 205*b*, as shown in FIG. 26, the wall body 207*b* of the orbiting scroll 207 has a shoulder portion (wall-body shoulder portion) 233 at a place corresponding to the step portion 227 of the fixed scroll 205, the height of the shoulder portion 233 being small at a central side along the spiral direction of the wall body 207*b* and being great at an exterior end side.

Figure 28:
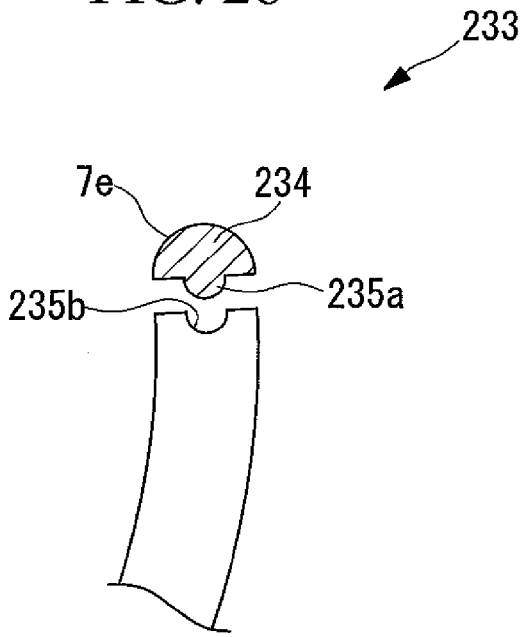
FIG. 28 is a partially enlarged view illustrating the structure of a shoulder portion of the orbiting scroll shown in FIG. 26.

FIG. 28 is a partial enlarged view illustrating the structure of the shoulder portion of the orbiting scroll shown in FIG. 26.

The wall-body contact portion 234, which is made of an abrasion-resistant metal, a ceramic or the like, is detachably provided on the shoulder portion 233. The wall-body contact portion 234 is brought into contact with the end-plate contact portion 228 on the step portion 227 to slide there along and serves to prevent the abrasion of the shoulder portion 233. The wall-body contact portion 234 has the connection edge 7*e* which slides along the end-plate contact portion 228 and a protruding portion 235*a* to be fitted in a recess portion 235*b* of the shoulder portion 233. That is, in the shoulder portion 233, the recess portion 235*b* to be fitted with the protruding portion 235*a* of the wall-body contact portion 234 is formed.

When the protruding portion 235*a* and the recess portion 235*b* are fitted to each other, the positional relationship between the wall body 207*b* and the wall-body contact portion 234 can be determined, and in addition, the position of the wall-body contact portion 234 is prevented from being shifted by the revolution of the orbiting scroll 207.

Since the wall-body contact portion 234 is pressed to the wall body 207*b* when it is brought into contact with the end-plate contact portion 228 on the step portion 227 and slides there along, it is not necessary to fix the wall-body contact portion 234 to the wall body 207*b* with an adhesive or the like.

Next, the operation of the scroll compressor 201 having the structure described above will be described.

Since the compression of a fluid by the scroll compressor 201 is approximately equivalent to that in the first embodiment, a description thereof will be omitted. In addition, the operation of the rotation prevention of the orbiting scroll, which is a feature of the present invention, is also approximately equivalent to that in the first embodiment, and hence description thereof is also omitted.

According to the structure described above, since the wall-body contact portion 234 is provided on the shoulder portion 233, and the end-plate contact portion 228 is provided on the step portion 227, the degradation in rotation-preventing performance for the orbiting scroll can be prevented.

Since the wall-body contact portion 234 made of a member having abrasion-resistant properties is provided on the contact portion of the shoulder portion 233 with the step portion 227, abrasion of the contact portion of the shoulder portion 233 can be prevented. In addition, since the end-plate contact portion 228 made of a member having abrasion-resistant properties is provided on the contact portion of the step portion 227 with the shoulder portion 233, abrasion of the contact portion of the step portion 227 can be prevented. Since the abrasion is prevented, the contact state between the shoulder portion 233 and the step portion 227 can be maintained constant, and the degradation in rotation-preventing performance caused by the shoulder portion 233 and the step portion 227 can be prevented. In addition, since the wall-body contact portion 234 is attachable to and detachable from the shoulder portion 233, and the end-plate contact portion 228 is attachable to and detachable from the step portion 227, when the wall-body contact portion 234 and the end-plate contact portion 228 are replaced with new ones, the contact state between the shoulder portion 233 and the step portion 227 can always be maintained constant.

What is claimed is:

1. A scroll compressor comprising:

a housing;

a fixed scroll having a first end plate and a first spiral wall body vertically provided on one surface of the first end plate;

an orbiting scroll which has a second end plate and a second spiral wall body vertically provided on one surface of the second end plate, wherein by engagement between the first spiral wall body and the second spiral wall body, the orbiting scroll is allowed to revolve or is prevented from rotation;

rotation-preventing portions which are provided for at least one of the housing and the orbiting scroll, and which allow the orbiting scroll to revolve or prevent the rotation of the orbiting scroll;

each of wall-body shoulder portions provided along an upper edge of the second spiral wall body and the first spiral wall body, the height of the wall-body shoulder portion being smaller at a central side in the spiral direction of the second and first spiral wall bodies and being greater at an exterior end side; and each of end-plate step portions provided on said one surface of the first and second end plates at a position facing the wall-body shoulder portion of the second and first spiral wall bodies, respectively, the height of the end-plate step portion being greater at a central side in the spiral direction of the first and second spiral wall bodies and being smaller at an exterior end side of the first spiral wall body;

wherein a phase at which the wall-body shoulder portion is disposed with respect to the center of the orbiting scroll is different from phases at which the rotation-preventing portions are disposed, wherein, among intervals between the phases at which the rotation-preventing portions are disposed with respect to the center of the orbiting scroll, at least one interval is larger than the other intervals, and wherein the wall-body shoulder portion of the second spiral wall body or the end-plate step portion of the first spiral wall body is disposed between rotation-preventing portions forming said at least one interval.

2. A scroll compressor comprising:

a housing;

a fixed scroll having a first end plate and a first spiral wall body vertically provided on one surface of the first end plate;

an orbiting scroll which has a second end plate and a second spiral wall body vertically provided on one surface of the second end plate, wherein by engagement between the first spiral wall body and the second spiral wall body, the orbiting scroll is allowed to revolve or is prevented from rotation;

rotation-preventing portions which are provided for at least one of the housing and the orbiting scroll, and which allow the orbiting scroll to revolve or prevent the rotation of the orbiting scroll;

each of wall-body shoulder portions provided along an upper edge of the second spiral wall body and the first spiral wall body, the height of the wall-body shoulder portion being smaller at a central side in the spiral direction of the second and first spiral wall bodies and being greater at an exterior end side; and each of end-plate step portions provided on said one surface of the first and second end plates at a position facing the wall-body shoulder portion of the second and first spiral wall bodies, respectively, the height of the end-plate step portion being greater at a central side in the spiral direction of the first and second spiral wall bodies and being smaller at an exterior end side of the first spiral wall body;

wherein a phase at which the wall-body shoulder portion is disposed with respect to the center of the orbiting scroll is different from phases at which the rotation-preventing portions are disposed, and wherein the rotation-preventing portions and the wall-body shoulder portion of the second spiral wall body or the end-plate step portion of the first spiral wall body are disposed at approximately equivalent intervals with respect to the center of the orbiting scroll.

* * * * *